US006483052B2

(12) United States Patent
Joyce et al.

(10) Patent No.: US 6,483,052 B2
(45) Date of Patent: Nov. 19, 2002

(54) ELECTROMECHANICAL APPLIANCE PROGRAMMER/TIMER

(75) Inventors: Ronald S. Joyce, Elk Grove Village, IL (US); Paul H. Tuma, Lombard, IL (US); James E. Pearson, Downers Grove, IL (US)

(73) Assignee: Ranco Incorporated of Delaware, Wilmington, DE (US)

( * ) Notice: Subject to any disclaimer, the term of this patent is extended or adjusted under 35 U.S.C. 154(b) by 0 days.

(21) Appl. No.: 09/813,229

(22) Filed: Mar. 20, 2001

(65) Prior Publication Data

US 2002/0134654 A1 Sep. 26, 2002

(51) Int. Cl.[7] ..... H01H 43/00; H01H 11/00

(52) U.S. Cl. ..... 200/38 R; 200/38 A; 200/38 B; 200/38 C; 29/622

(58) Field of Search ..... 200/33 R–40; 29/622

(56) References Cited

U.S. PATENT DOCUMENTS 3,725,618 A * 4/1973 Voland et al. ..... 200/38 C X
3,809,831 A * 5/1974 Godwin et al. ..... 200/38 C
3,819,886 A * 6/1974 Homan et al. ..... 200/38 B
4,521,722 A * 6/1985 Barthel et al. ..... 318/578
4,531,028 A 7/1985 Stout et al. ..... 200/38 R
4,604,504 A * 8/1986 Stout et al. ..... 200/38 B
4,636,595 A 1/1987 Smock et al. ..... 200/38 R
4,935,952 A 6/1990 Dutra ..... 379/40
4,999,607 A 3/1991 Evans ..... 240/533
5,025,117 A 6/1991 Cole et al. ..... 200/38 R
5,138,120 A 8/1992 Adams ..... 200/38 R
5,637,843 A * 6/1997 Joyce et al. ..... 200/38 R
5,780,791 A 7/1998 Cole ..... 200/38 R
5,828,019 A 10/1998 Joyce ..... 200/38 B
5,831,230 A 11/1998 Cole ..... 200/38 R
5,834,718 A 11/1998 Amonett et al. ..... 200/38 R
5,866,863 A 2/1999 Cole ..... 200/38 R
5,889,244 A 3/1999 Kraus ..... 200/38 R
5,910,648 A 6/1999 Moritz ..... 181/175
5,910,649 A 6/1999 Amonett et al. ..... 200/38 R

* cited by examiner

*Primary Examiner*—J. R. Scott
(74) *Attorney, Agent, or Firm*—Sampson & Associates, P.C.

(57) ABSTRACT

A programmer/timer having a cam disk that includes concentric cam tracks having multiple working heights formed on one face thereof. The programmer/timer further includes a plate assembly that includes multiple cam followers for engaging cam disk and a plurality of single pole double throw switches configured for multiple working heights disposed for actuation by cam followers.

21 Claims, 27 Drawing Sheets

ELECTROMECHANICAL APPLIANCE PROGRAMMER/TIMER

BACKGROUND OF THE INVENTION (1) Field of the Invention

The present invention relates to programmer/timers. More specifically this invention relates to programmer/timers having a plurality of switches actuated in a timed sequence for controlling the operation of an appliance.

(2) Background Information

Appliance programmer/timers are commonly used in many household appliances, such as dishwashers, clothes washers, and clothes dryers. The appliance timer controls operation of the appliance by actuating and deactuating switch assemblies, which start and stop various work functions within the appliance, such as agitation, washing, spinning, drying, and others.

Cam-operated programmer/timers are complex electromechanical devices having many mechanical components, typically including a housing with a control shaft that serves as an axis of rotation for a drum-shaped cam, referred to as a camstack. The camstack is rotated via a drive system that is powered by an electric motor. When the camstack rotates, cam followers engage the cam blades and actuate and deactuate switch assemblies in response to the cam blade program. A knob is generally placed on the end of the control shaft, which extends through the appliance control consol for an operator to select an appliance program.

Recently, Joyce et al., in U.S. Pat. No. 5,637,843, hereinafter referred to as the '843 patent, disclosed a programmer/timer with a cam disk. The '843 patent is fully incorporated herein by reference. The cam disk has single working height cam tracks formed concentrically on one face thereof. A cam disk was employed to overcome undesired inaccuracies in making and breaking of side contact associated with timers employing a camstack construction, especially for those in which single pole double-throw (SPDT) type switching was required. The cam disk was also employed to provide a means of disengaging the cam from the followers to eliminate the noise associated with switch actuation and deactuation during setting of the program cam by a user.

While the programmer/timer disclosed in the '843 patent represents a significant advancement, a programmer/timer with additional functionality and improved versatility is generally preferred in order to appropriately serve the numerous programmer/timer markets. Further improvements to simplify manufacturability and thereby reduce costs are also desirable.

SUMMARY OF THE INVENTION

One aspect of the present invention is an electromechanical programmer/timer for appliances of the type employing a rotatable cam disk that includes a plurality of cam tracks provided on an axial face of the disk. Upon advancement of the cam, the cam tracks effect sequential actuation and deactuation, through individual cam followers mounted on a plate assembly, of a plurality of appliance function control switches. The cam tracks in this invention include two or more working heights and the switches are configured for multiple working heights. The cam is retractably mounted such that it may be retracted axially from the plate assembly, permitting rotation of the cam without causing actuation of the switches. The programmer/timer of this invention employs a drive mechanism that advances the cam disk. In an optional variation, the drive mechanism may include a motor pinion that engages a perimeter gear on the cam disk. The programmer/timer of this invention may embrace numerous variations as described hereinbelow.

DETAILED DESCRIPTION

Figure 1:
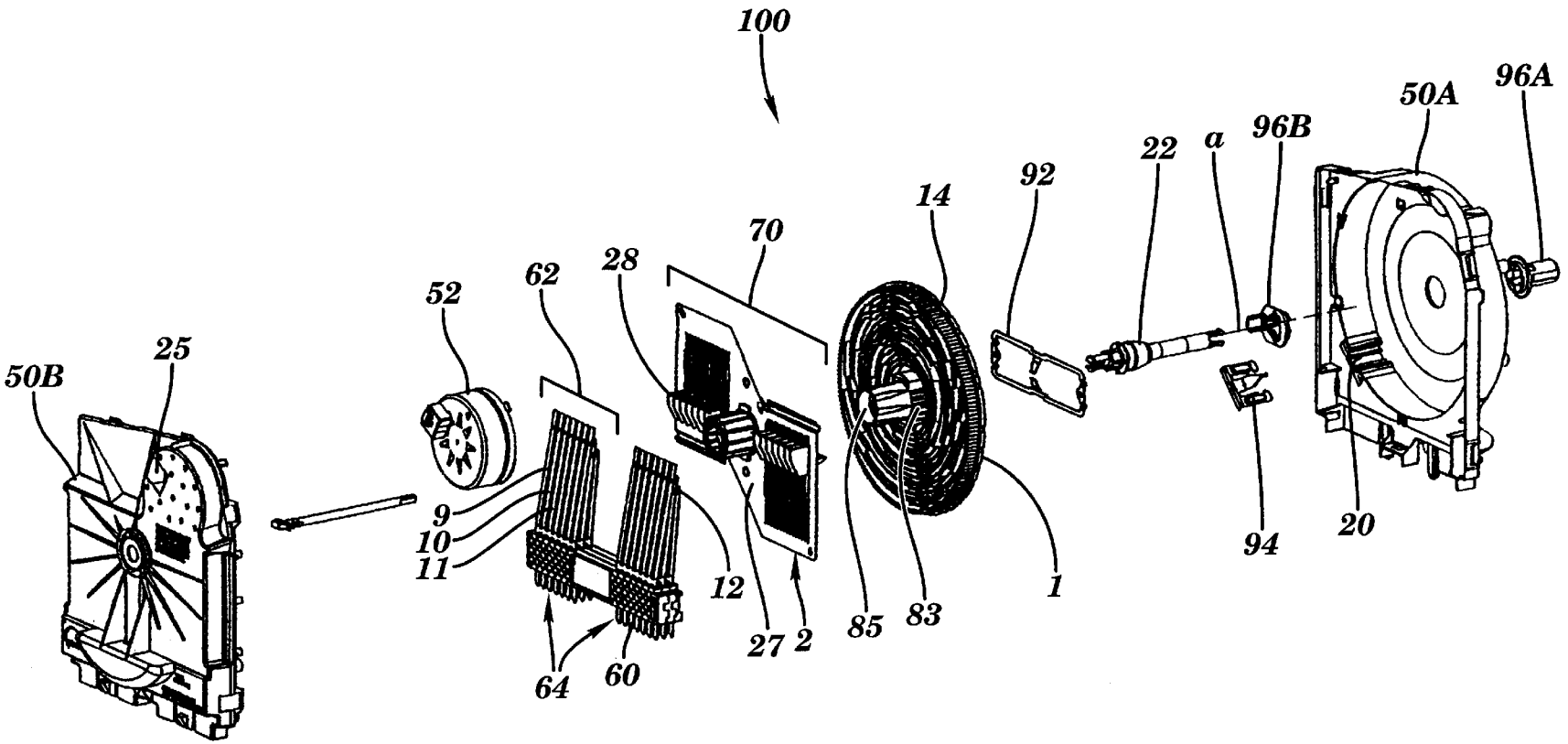
FIG. 1 is an exploded view of a two-connector embodiment of the programmer/timer of this invention.

Where used in this disclosure, the term "axial" when used in connection with an element described herein, shall refer to a direction relative to the element, which is substantially parallel to its center of rotation a when the element is installed on shaft 22 as shown in FIG. 1.

Figure 2:
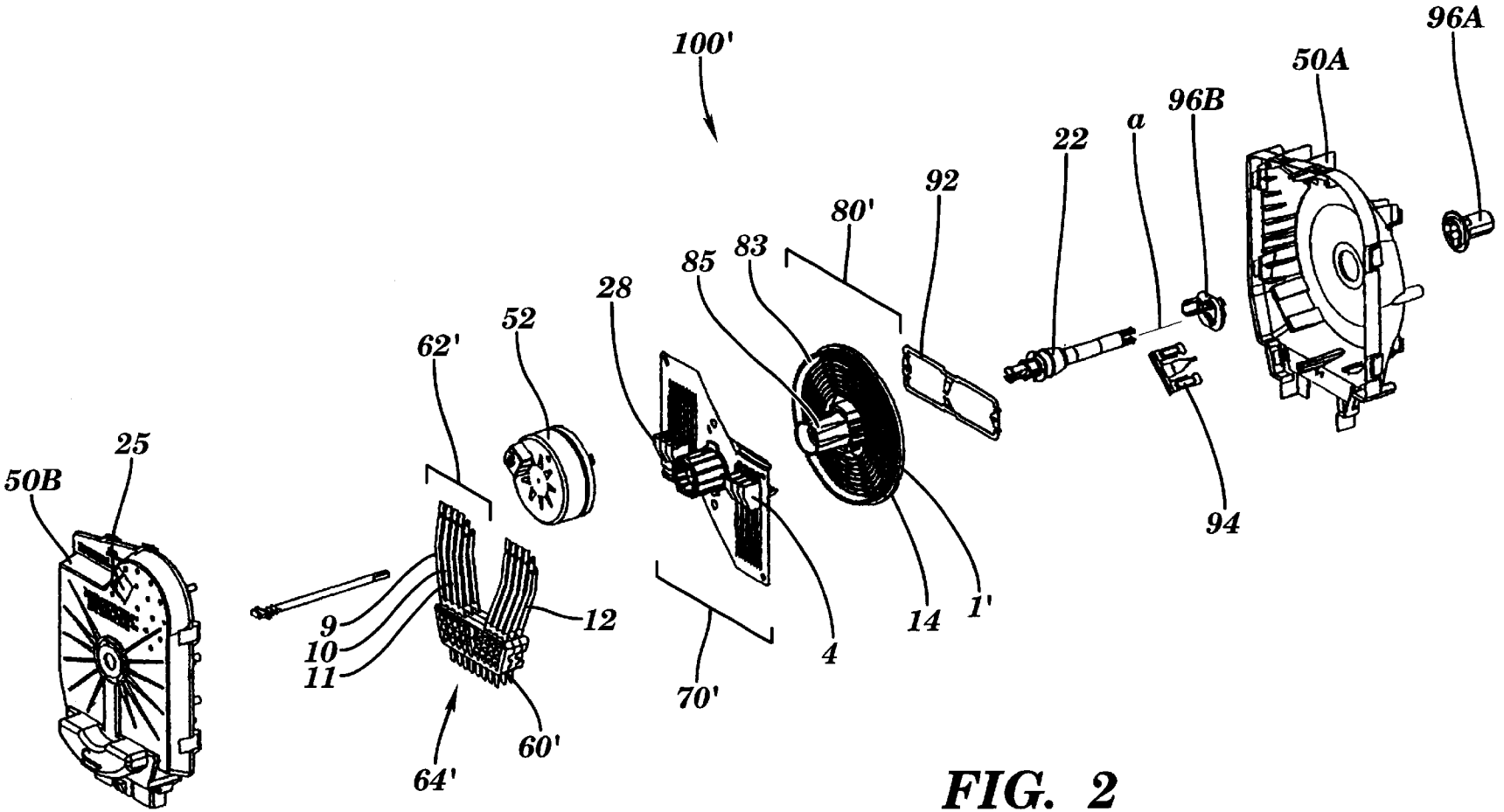
FIG. 2 is an exploded view of a single connector embodiment of the programmer/timer of this invention.

Referring to FIGS. 1 and 2, the programmer/timer of the present invention is indicated generally at 100 and 100'. Programmer/timer 100, 100' includes a housing 50A, 50B with a motor 52 mounted therein. A cam, preferably in the form of a cam disk assembly 80, 80', is rotatably mounted about a control shaft 22, which is received into a two-piece hub 96A, 96B. Cam disk assembly 80, 80' includes a cam disk 1 with a plurality of cam tracks 83 formed concentrically in one face thereof Cam tracks 83 are further configured to have multiple working heights. Cam disk assembly 80, 80' further includes a perimeter gear 14 connected via a drive assembly to motor 52 for rotation of the cam. Programmer/timer 100, 100' further includes a plate assembly 70, 70' that includes a plurality of cam followers and pads, denoted generally as 2 and 4, respectively, which engage cam tracks 83. Programmer/timer 100, 100' still further includes a switch assembly, denoted generally as 60, which includes a plurality of switches 62 electrically connected to one or more connectors 64, 64'. Programmer/timer 100' is configured substantially identically to programmer/timer 100 with the exception that the switch assembly 60', the plate assembly 70' and the disk assembly 80' are configured for a device having a single connector 64' and typically fewer switches 62, cam followers 2 and cam tracks 83. The structure and function of individual switches as well as several variations to the programmer/timer of this invention are discussed further hereinbelow.

Figure 3:
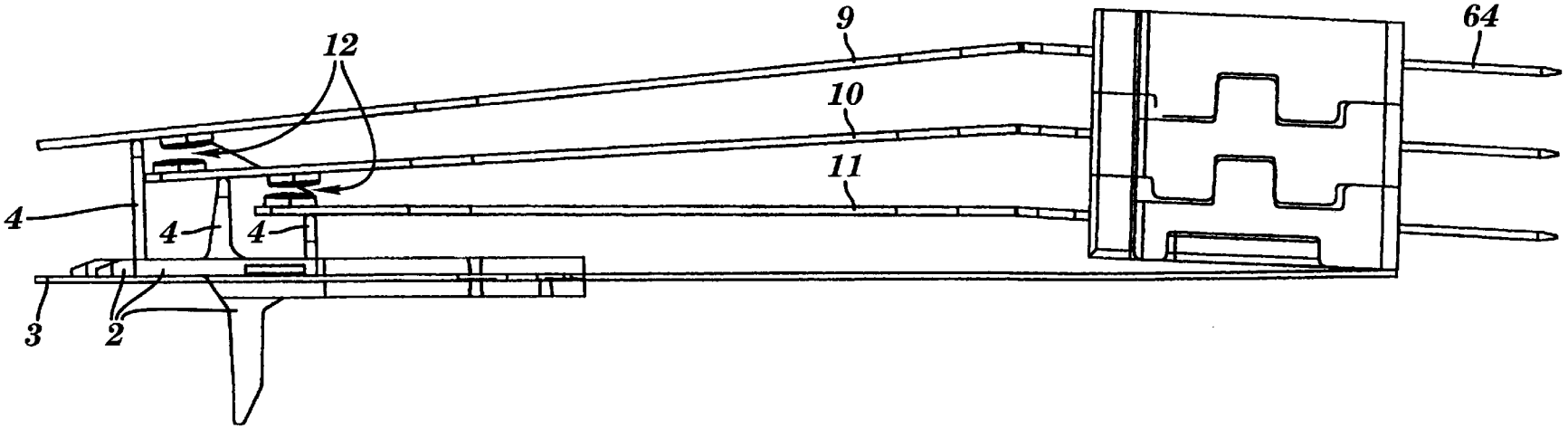
FIG. 3 is a schematic of a switch of the present invention wherein a cam disk is retracted.
Figure 20:
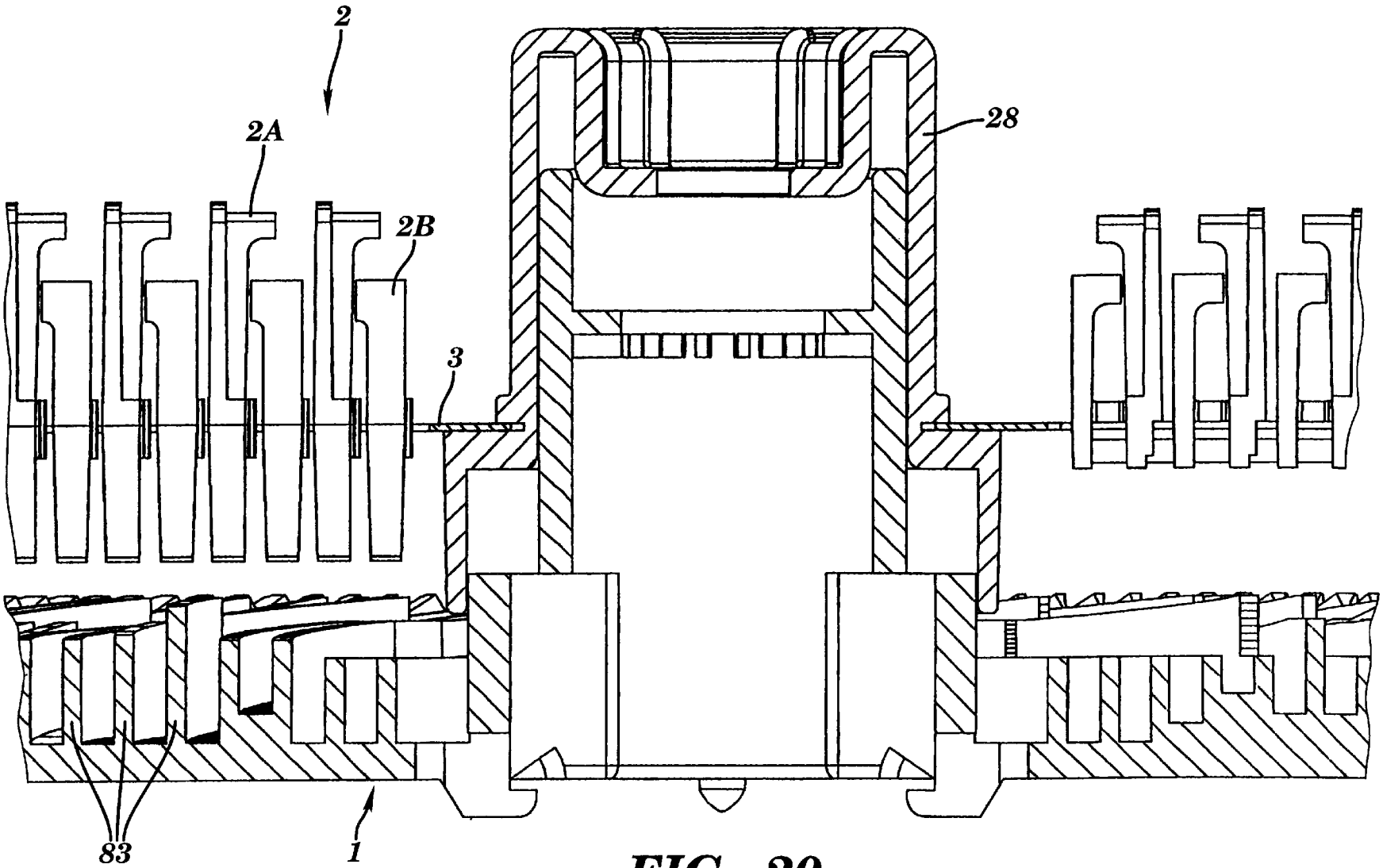
FIG. 20 is a cross sectional schematic of the program timer of this invention showing a cam disk retracted from cam followers.

One feature of the switches 62 disclosed herein is shown in FIGS. 3 and 20. Upon retraction of disk 1 from plate assembly 70, 70', the cam followers, indicated generally by 2, rest on the follower plate 3, resulting in all switches 62 being open. In this embodiment all switches 62 assume the function of a line switch. As used herein, the term "line switch" refers to a switch that is dedicated to the function of turning an appliance on and off. In prior art programmer/timers, the switches continually engage the cam, and therefore, an additional mechanism is generally required for a switch dedicated to on-off functionality, in order to achieve switching action when a user enacts an axial motion of the shaft. This invention is potentially advantageous in that a conventional line switch is not required, since all switches move to the 'off' state when disk 1 is retracted. It will be clear to the artisan of ordinary skill that switches 62 may be configured to be open or closed (with any combination of switches 62 open and/or closed) simply by varying the height of the follower pads 4 on which the switch blades 9, 10, 11 rest.

Figure 21:
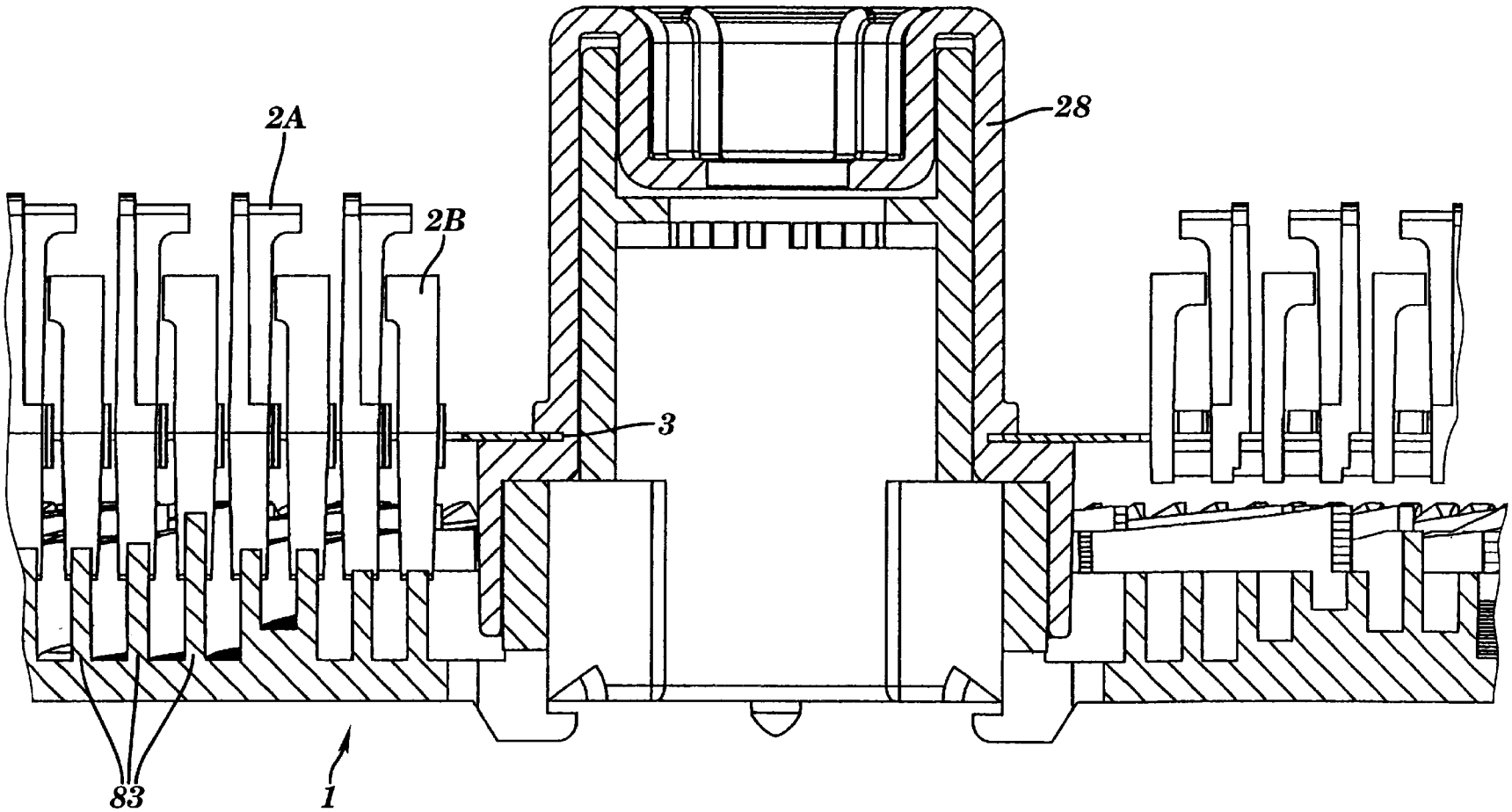
FIG. 21 is across sectional schematic of the programmer/timer of this invention showing cam followers riding on the surface of a cam disk.

Another feature of the switches 62 disclosed herein, as shown in FIGS. 4–8, is that they are configured to function in a "drop to make, drop to break" manner with a cam having multiple working heights. This enables programmer/timer 100, 100' to produce a series of short on/off cycles without having to reinitiate switches 62 between each cycle. Two cam followers 2A, 2B are typically utilized for each switch. Referring to FIG. 21, each cam follower 2A, 2B rides on a distinct cam track 83. Cam disk assembly 80, 80' is designed to raise cam followers 2A, 2B to a working height and then drop them off an edge to provide rapid closure or opening of the contacts 12, hence switches 62 being referred to as "drop to make, drop to break" switches.

Figure 5:
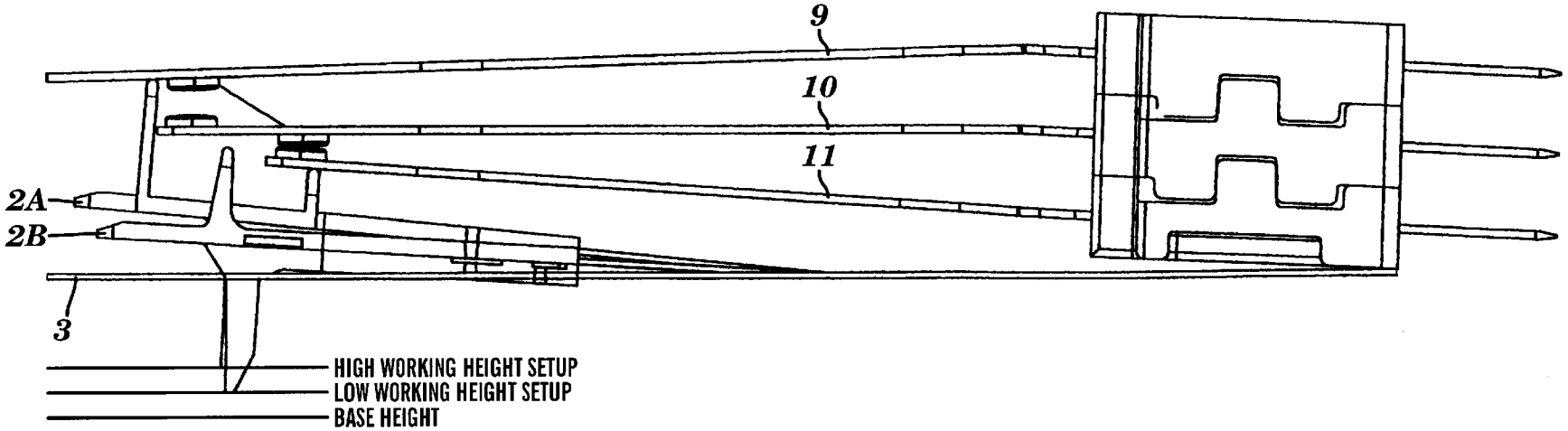
FIG. 5 is a schematic of the switch of FIG. 4 wherein the middle follower has dropped to a relatively low working height establishing contact between the middle and bottom blades.

One cam follower, shown in FIG. 5 and referred to as the top/bottom follower 2A, moves the top blade 9 and the bottom blade 11. The other cam follower, also shown in FIG. 5 and referred to as the middle follower 2B, moves the middle blade 10. Top blade 9, middle blade 10, and bottom blade 11 act as cantilever springs biased against pads 4 (shown in FIG. 3) on the two cam followers 2A, 2B. Referring again to FIG. 3, two pairs of contacts 12 are mounted on the three blades 9, 10, and 11 to provide. points of electrical contact therebetween. Referring now to FIG. 5, electrical contact between bottom blade 11 and middle blade 10 is obtained when top/bottom follower 2A is sufficiently higher than middle follower 2B, such that top/bottom follower 2A lifts lower blade 11 into contact with middle blade 10, thereby lifting it from its pad. Electrical contact between top blade 9 and middle blade 10 is obtained when middle follower 2B is sufficiently higher than top/bottom follower 2A, to lift middle blade 10 into contact with top blade 9, thereby lifting it from its pad (this configuration wherein contact is made between top blade 9 and middle blade 10 is not shown in the Figures).

Referring now to FIGS. 4–8, the multiple height functionality of switches 62 is described. For this purpose, an embodiment having two working heights is explained, however, it shall be understood that embodiments including more that two working heights are well within the scope of this invention. FIGS. 4–8 show three cam track 83 levels, a base level 83A, and two working height levels, a relatively low working height 83B and a relatively high working height 83C. Working heights 83B, 83C are cam positions in which cam followers 2A, 2B are disposed against their bias away from base level 83A. As shown, cam followers 2A, 2B are disposed farther from the base level 83A at the relatively high working height 83C than at the relatively low working height 83B. In the example that follows working heights 83B and 83C are referred to as low and high working heights, respectively.

Figure 4:
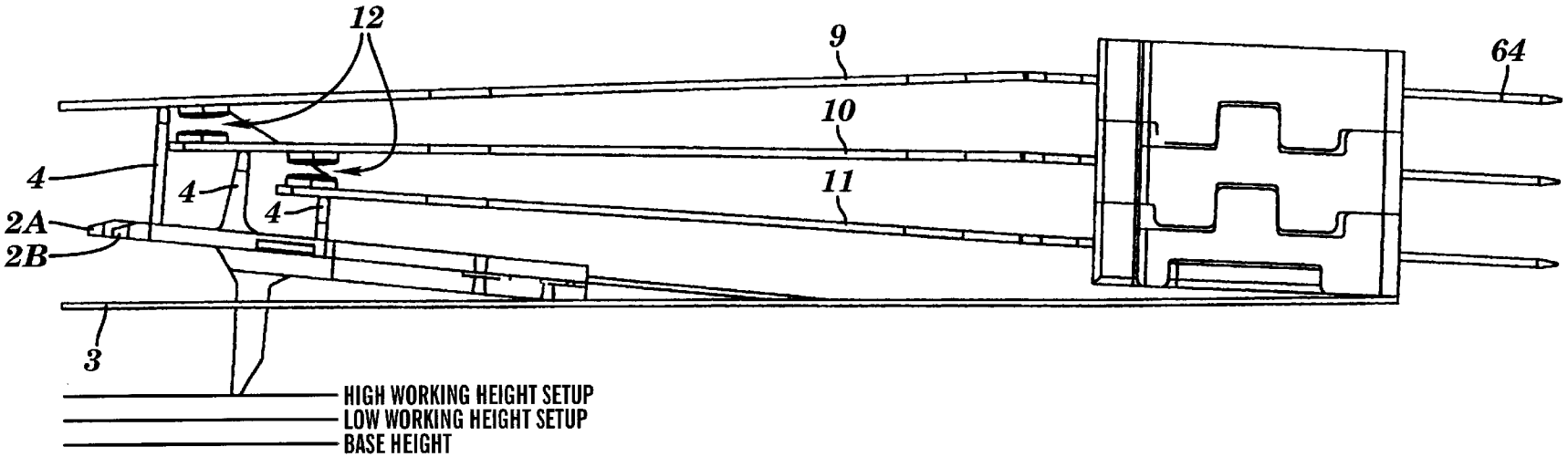
FIG. 4 is a schematic of a switch with both cam followers set at a relatively high working height.
Figure 6:
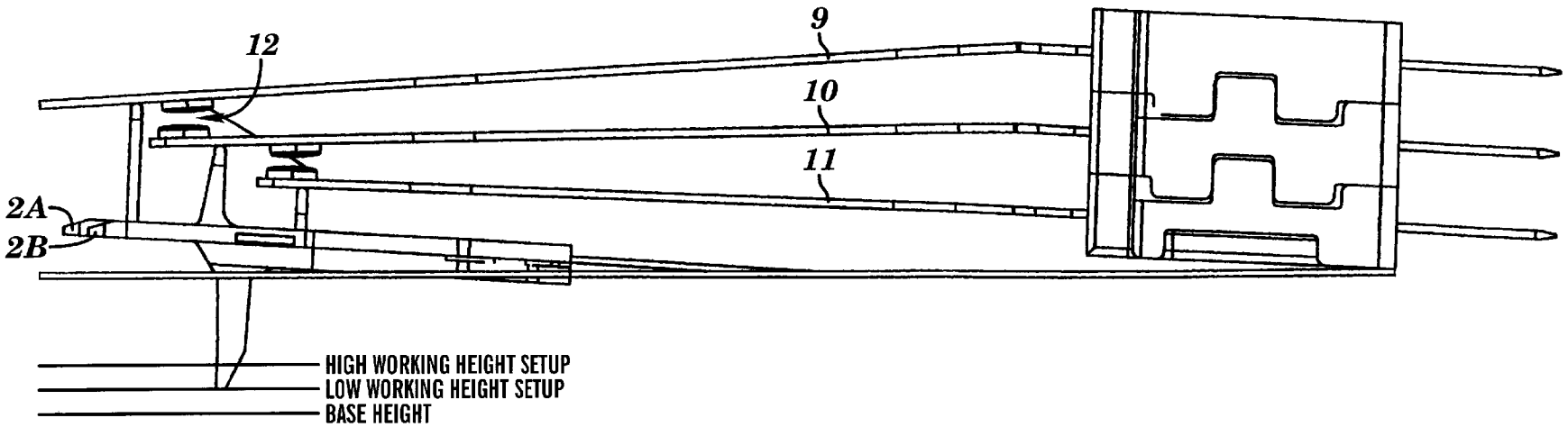
FIG. 6 is a schematic of the switch of FIG. 5 wherein the top/bottom follower has dropped to a relatively low working height breaking contact between the middle and bottom blades.
Figure 7:
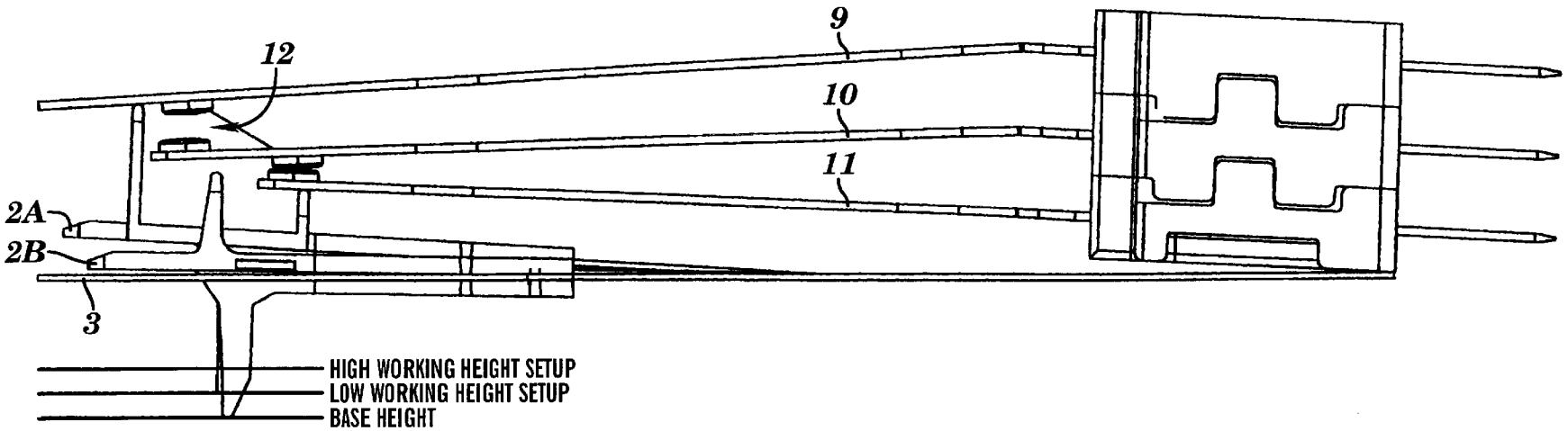
FIG. 7 is a schematic of the switch of FIG. 6 wherein the middle follower has dropped to a base height again establishing contact between the middle and bottom blades.
Figure 8:
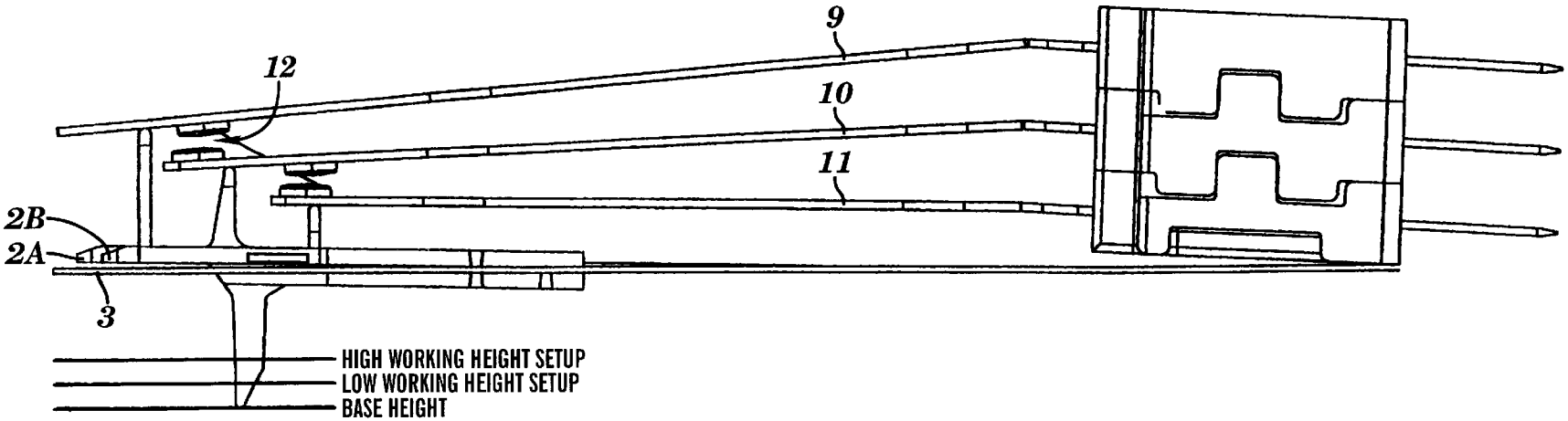
FIG. 8 is a schematic of the switch of FIG. 7 wherein the top/bottom follower has dropped to a base height again breaking contact between the middle and bottom blades.

In FIG. 4 the switch is shown with both cam followers 2A, 2B disposed at high working height 83C. In FIG. 5 middle follower 2B has dropped down to low working height 83B, establishing contact between middle blade 10 and bottom blade 11. In FIG. 6 top/bottom follower 2A has dropped down to low working height 83B, breaking electrical contact between middle blade 10 and bottom blade 11. As illustrated in FIG. 6, switch 62 is "off" and setup to cycle again. In FIG. 7 middle follower 2B has dropped from low working height 83B to base level 83A, again establishing contact between middle blade 10 and bottom blade 11. In FIG. 8 top/bottom follower 2A has dropped from low working height 83B to base level 83A, again breaking electrical contact between middle blade 10 and bottom blade 11. For the configuration of switches 62 shown, cam followers 2A, 2B need to be raised up to one of the working heights 83B, 83C prior to initiating another cycle.

The embodiment described hereinabove is merely exemplary. As stated above, one of ordinary skill in the art will readily recognize that more than two working heights may be utilized. Further, it will be recognized that numerous other switching sequences may be established. For example a cycle that involves making and breaking contact between top blade 9 and middle blade 10 may be established simply by having top/bottom follower 2A drop first. Alternately, a cycle which involves first making and breaking contact between top blade 9 and middle blade 10 followed by making and breaking contact between middle blade 10 and bottom blade 11 may be easily established.

One additional advantage of employing a cam disk assembly 80, 80' including multiple working heights as disclosed herein, is that a switching sequence in which the switches 62 are transitioned directly from a top make condition (contact between top blade 9 and middle blade 10) to a bottom make condition (contact between middle bladed 10 and bottom blade 11) and then back to a top make condition may be established. In this sequence, the switch does not rest in a neutral off position (one in which no contacts are made). This switching action may be accomplished by first positioning cam follower 2A at low working height 83B and cam follower 2B at high working height 83C and then dropping cam follower 2B directly to base level 83A. Cam followers 2A and 2B are then simultaneously raised (without breaking contact) one level so that cam follower 2A is positioned at high working height 83C and cam follower 2B is positioned at low working height 83B. Cam follower 2A is dropped directly to base level 83A. The above described sequence may be advantageously used in a washing machine when transitioning from an agitate to a spin cycle.

The marketplace for the programmer/timer of this invention requires a varying number of switches 62 depending upon the application. The programmer/timer of this invention may therefore have one or more connectors 64, 64', in order to accommodate applications wherein a large number of switches 62 are required. FIG. 1 shows one embodiment in which two connectors 64 each having seven single pole double throw (SPDT) switches 62 is utilized. FIG. 2 shows another embodiment in which one connector 64' having eight SPDT switches 62 is utilized.

Figure 9:
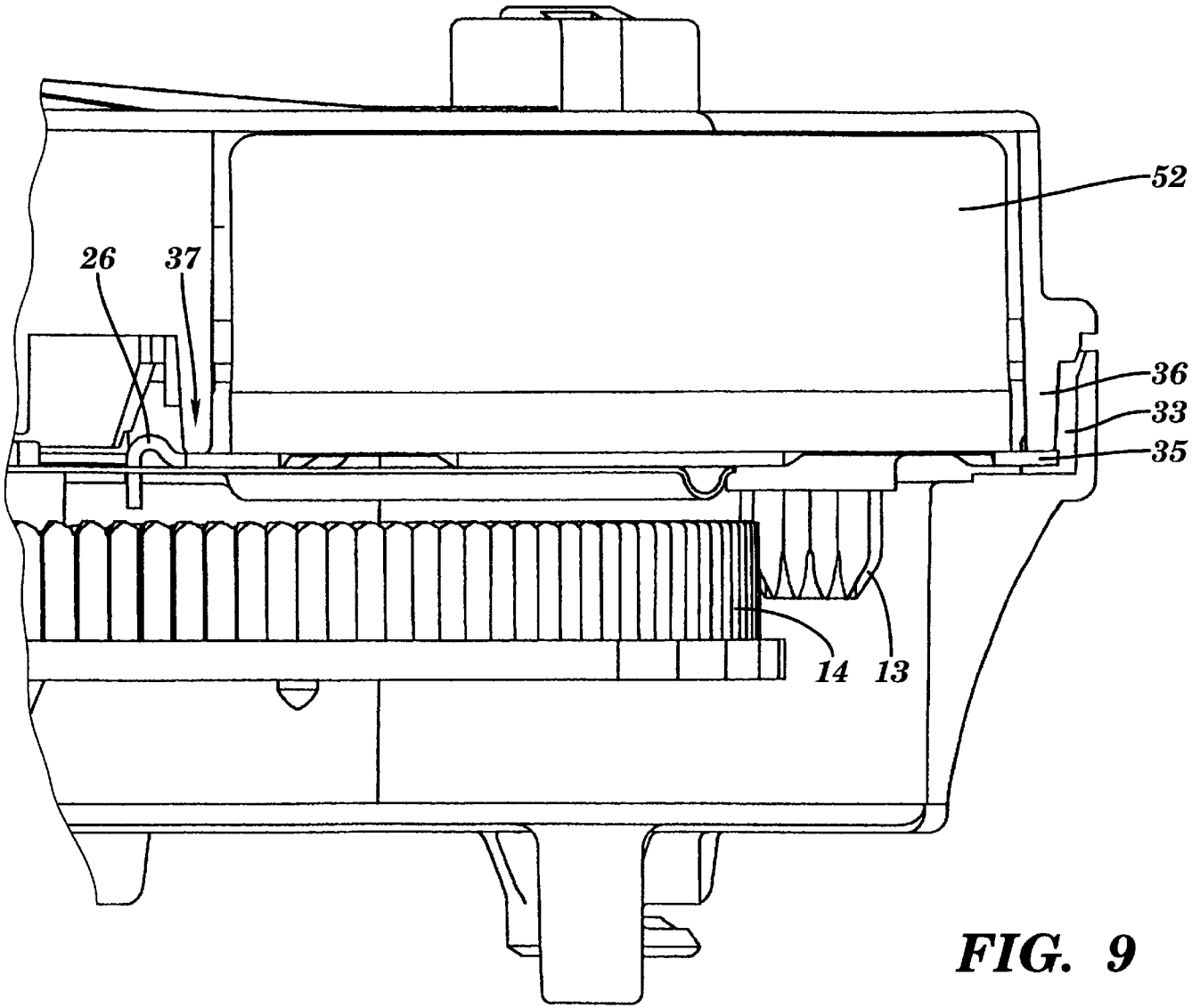
FIG. 9 is an expanded cross sectional view showing a motor pinion engaged with a perimeter gear on a cam disk.
Figure 10:
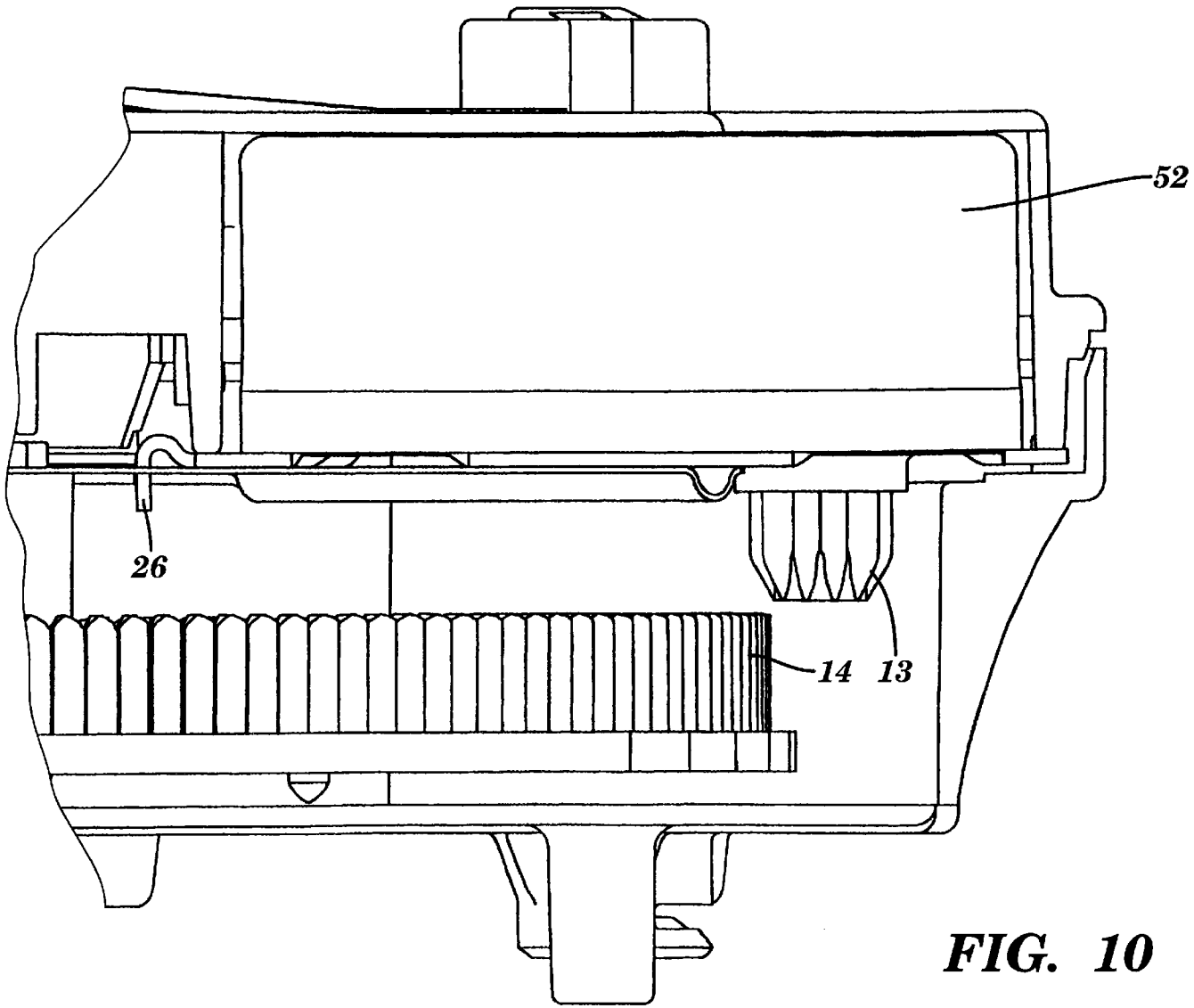
FIG. 10 is an expanded cross sectional view showing a motor pinion disengaged from a perimeter gear of a cam disk.
Figure 27:
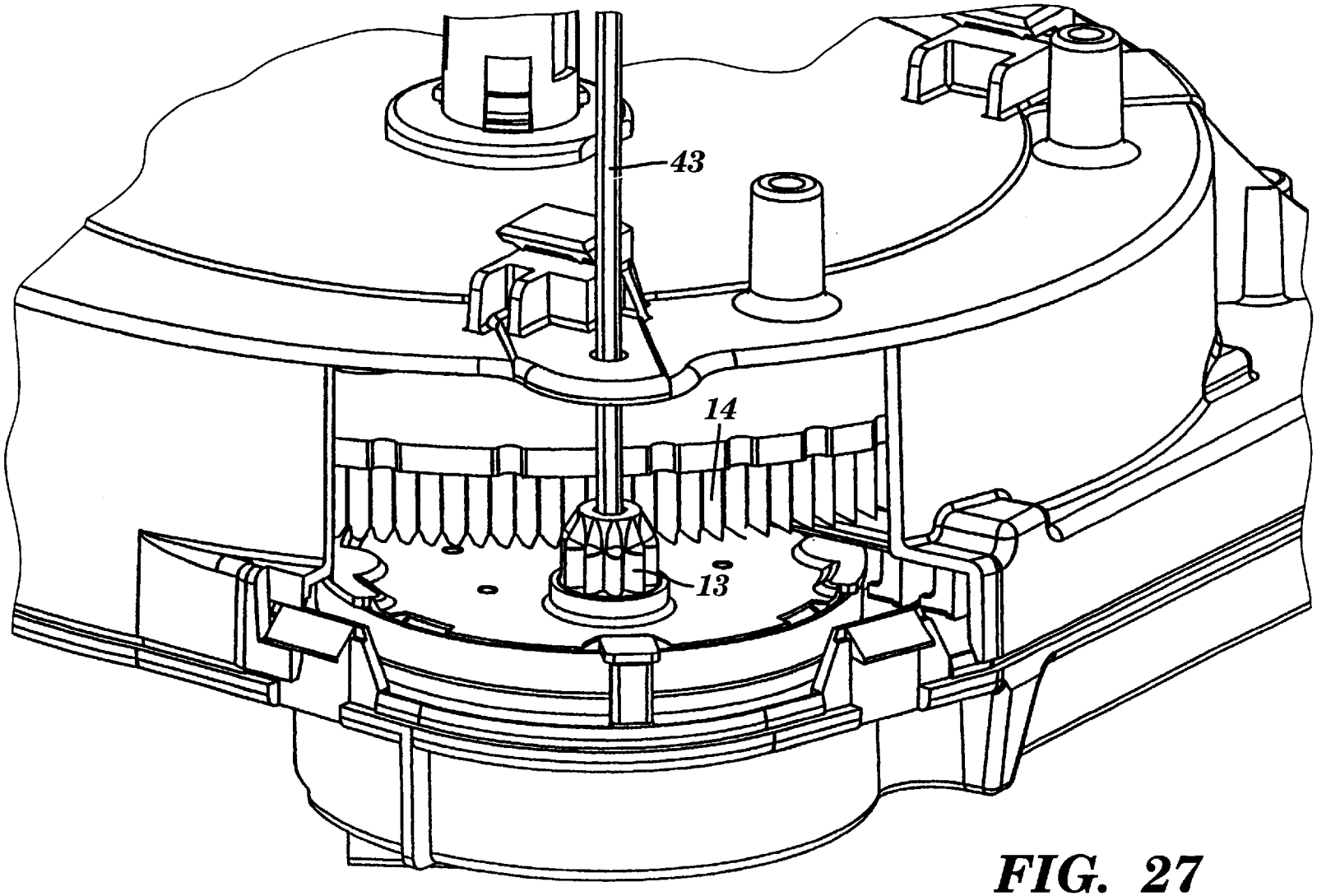
FIG. 27 is a view, with the housing cut away, of an external drive shaft inserted into a motor pinion.

Referring to FIGS. 9–10, a motor pinion 13, which is connected directly to motor 52, engages the perimeter gear 14 on disk 1 when disk 1 is engaged with cam followers 2. Motor pinion 13, and therefore motor 52, is disengaged from perimeter gear 14 when disk 1 is retracted from plate assembly 80 to allow a user to rotate disk 1, setting it to another position. Another feature of the drive of this embodiment is that motor pinion 13 may be driven externally in order to perform quality testing of the drive mechanism during manufacturing. FIG. 27 provides a view of the programmer/timer of this embodiment with housing 50A, 50B cut away to show a hex driver 43, representing an external drive for testing, inserted into engagement with motor pinion 13. Further, a one-way clutch mechanism (as disclosed in U.S. Pat. No. 5,088,581, which is fully incorporated herein by reference) may be included internally in motor 52. The clutch (not shown) allows motor pinion 13 to rotate forward independently of motor 52 to facilitate quality testing using an external drive. While the constant drive configuration described above is typically preferred, an intermittent motion drive mechanism, such as that described in the '843 patent, may also be employed.

Figure 14A:
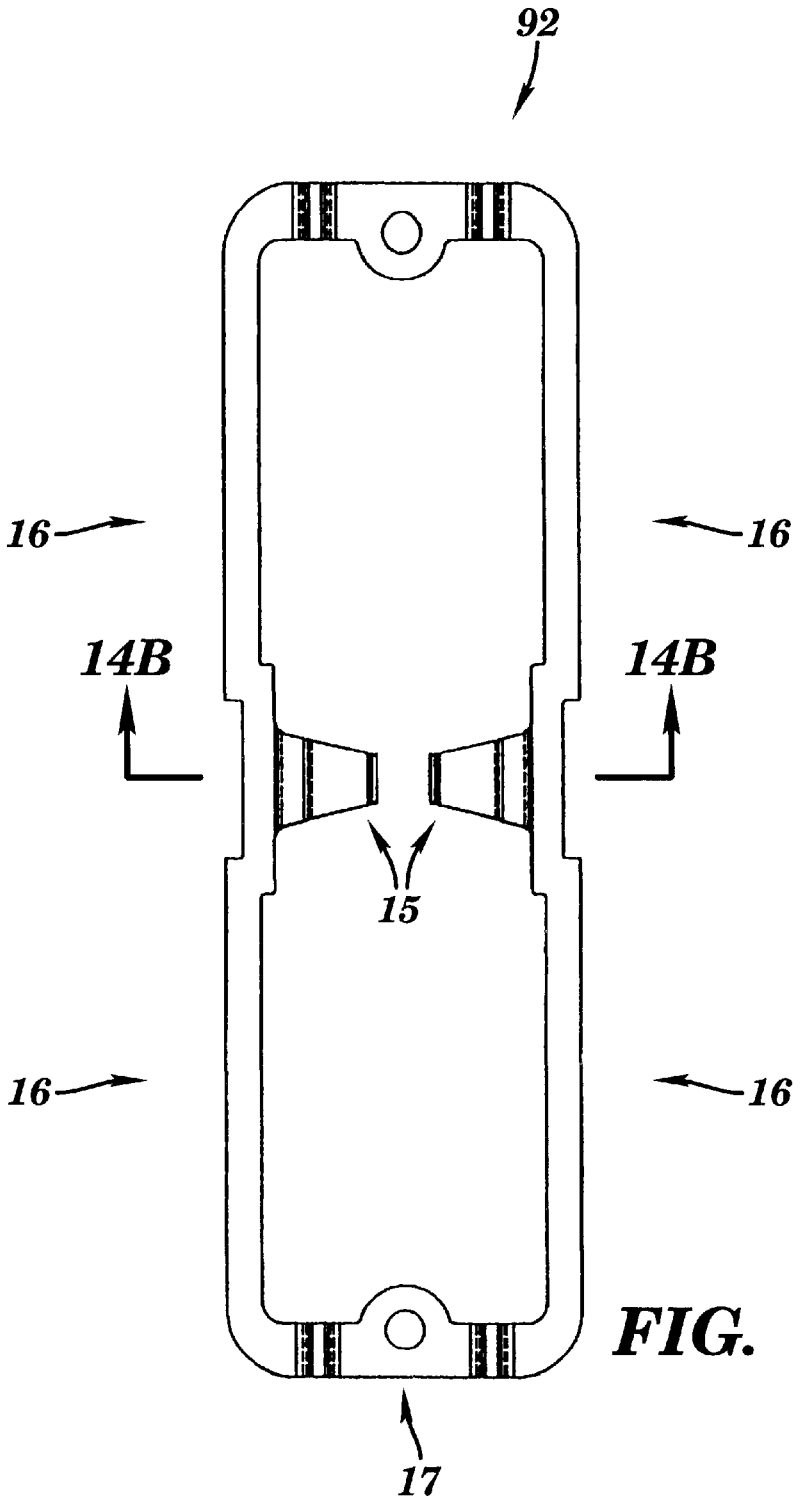
FIGS. 14A and 14B show a detent spring for urging a cam disk into contact with cam followers.
Figure 14B:
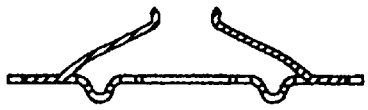
Figure 15:
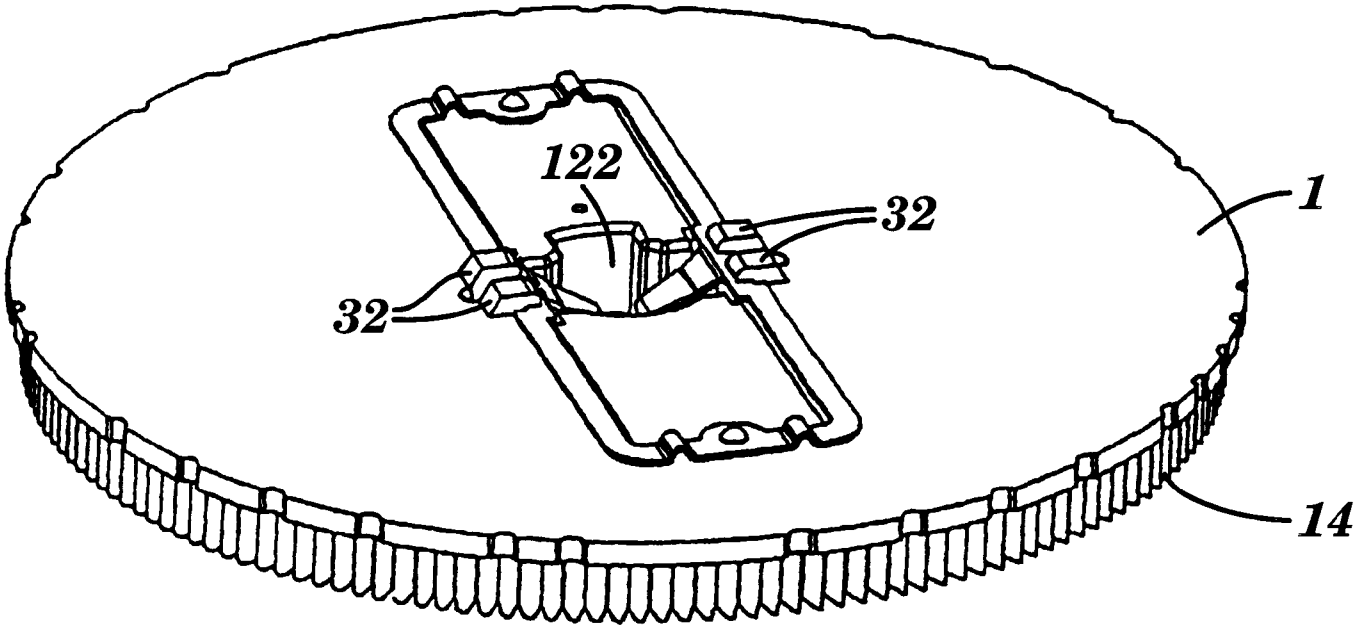
FIG. 15 depicts four tabs on a cam disk that trap the detent spring of FIGS. 14A and 14B.

Referring now to FIGS. 14A, 14B, and 15, the programmer/timer of this invention may include a detent spring 92 for providing the necessary force to firmly hold disk 1 in contact with cam followers 2. The spring 92 configuration disclosed herein may provide for increased reliability and spring life. Detent spring 92 is typically a metal stamping that includes at least two opposing cantilevers 15 that act like followers on a cam-like section (not shown in Figures) of shaft 22. When shaft 22 is moved axially relative to disk 1 (FIGS. 1 and 2) into engagement with cam followers 2 (FIGS. 2 and 21), cantilevers 15 are pushed into a suitably sized and shaped groove (not shown) in shaft 22. The cantilevers 15 are sized, shaped, and otherwise constructed to provide sufficient biasing force to maintain disk 1 in this engagement. When shaft 22 is moved axially relative to disk 1 into disengagement from cam followers 2, cantilevers 15 are moved against their bias from the groove and are positioned against the side of shaft 22. In one embodiment, each cantilever 15 is attached to a long narrow beam like section 16 that is put in torsion when the cantilevers 15 are moved against their bias, i.e., when they are moved out of the groove as discussed hereinabove. The symmetrical orientation of the cantilevers 15 and sections 16 is such that the torsion loads cancel each other out at the connected ends 17. Referring to FIG. 15, disk 1 includes four tabs 32 that capture the spring with sufficient clearance to permit the aforementioned pivoting action to occur. As shown, tabs 32 are preferably disposed on opposite sides of the shaft aperture 122, through which shaft 22 extends, proximate the junction of the cantilevers 15 and sections 16. In particular, it may be desirable to dispose tabs 32 in spaced relation along each section 16, on opposite sides of each cantilever 15, as shown. The geometry of the cantilevers 15 and the torsion beam 16 configuration are preferably optimized to evenly distribute the torsional stress along the length of sections 16. Another unique aspect of this spring design is it's efficient use of space. As shown in FIG. 15, detent spring 92 fits substantially fiat against the surface of disk 1.

Figure 16:
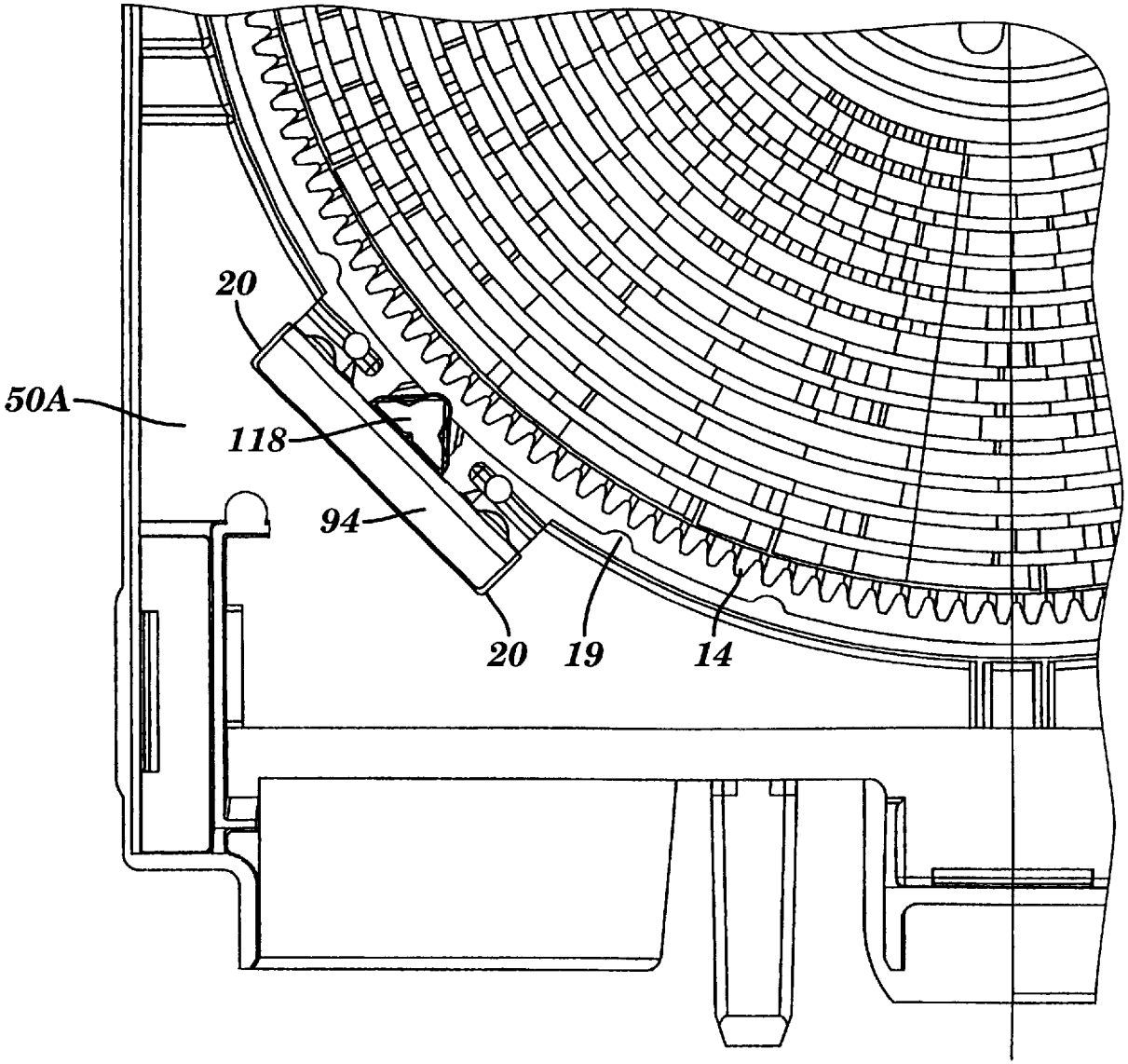
FIG. 16 shows a dial indicator spring engaging a cam disk.
Figure 17:
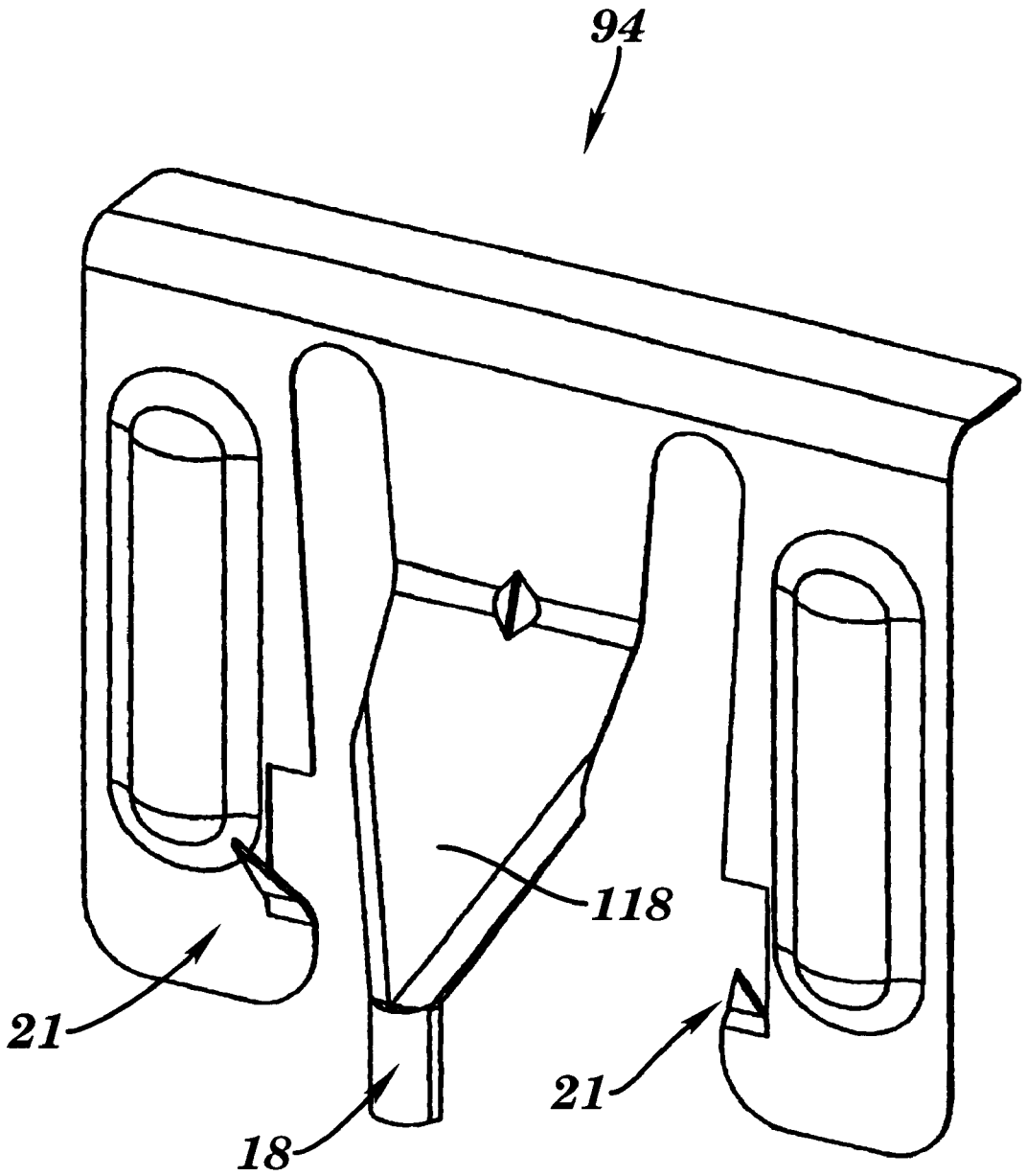
FIG. 17 shows a dial indicator spring for providing tactile feedback to a user.

Embodiments of the programmer/timer of this invention may further include a stamped metal dial indicator spring 94 (FIGS. 16 and 17) that acts as a spring loaded follower on the outer diameter of disk 1 to provide tactile feedback to a user when setting programmer/timer 100, 100' to the beginning of a cycle. Referring now to FIGS. 16–17, an integral follower tip 18 on dial indicator spring 94 drops into notches (i.e., detents) 19 on the perimeter of disk 1 to indicate the start location in a particular cycle (e.g. wash). Mechanisms used for this purpose in other designs typically require a separate spring and follower to accomplish the same task. The configuration of dial indicator spring 94 allows it to disengage from disk 1 when the disk is engaged with cam followers 2. This advantageously tends to prevent dial indicator spring 94 from influencing timing accuracy when programmer/timer 100, 100' runs through a location with a detent 19. Other known mechanisms used for this purpose generally do not disengage when the timer is running. When disk 1 is retracted from cam followers 2, a cam-like surface 118 on dial indicator spring 94 serves to re-engage tip 18 with detent 19 upon movement of disk 1 axially towards tip 18. In order to hold dial indicator spring 94 in place, a pocket 20 may be created in housing 50A, into which dial indicator spring 94 is retained. In addition, a barb 21 may be formed on each leg of the dial indicator spring 94 to retain it in pocket 20 after being pressed into position.

Figure 18:
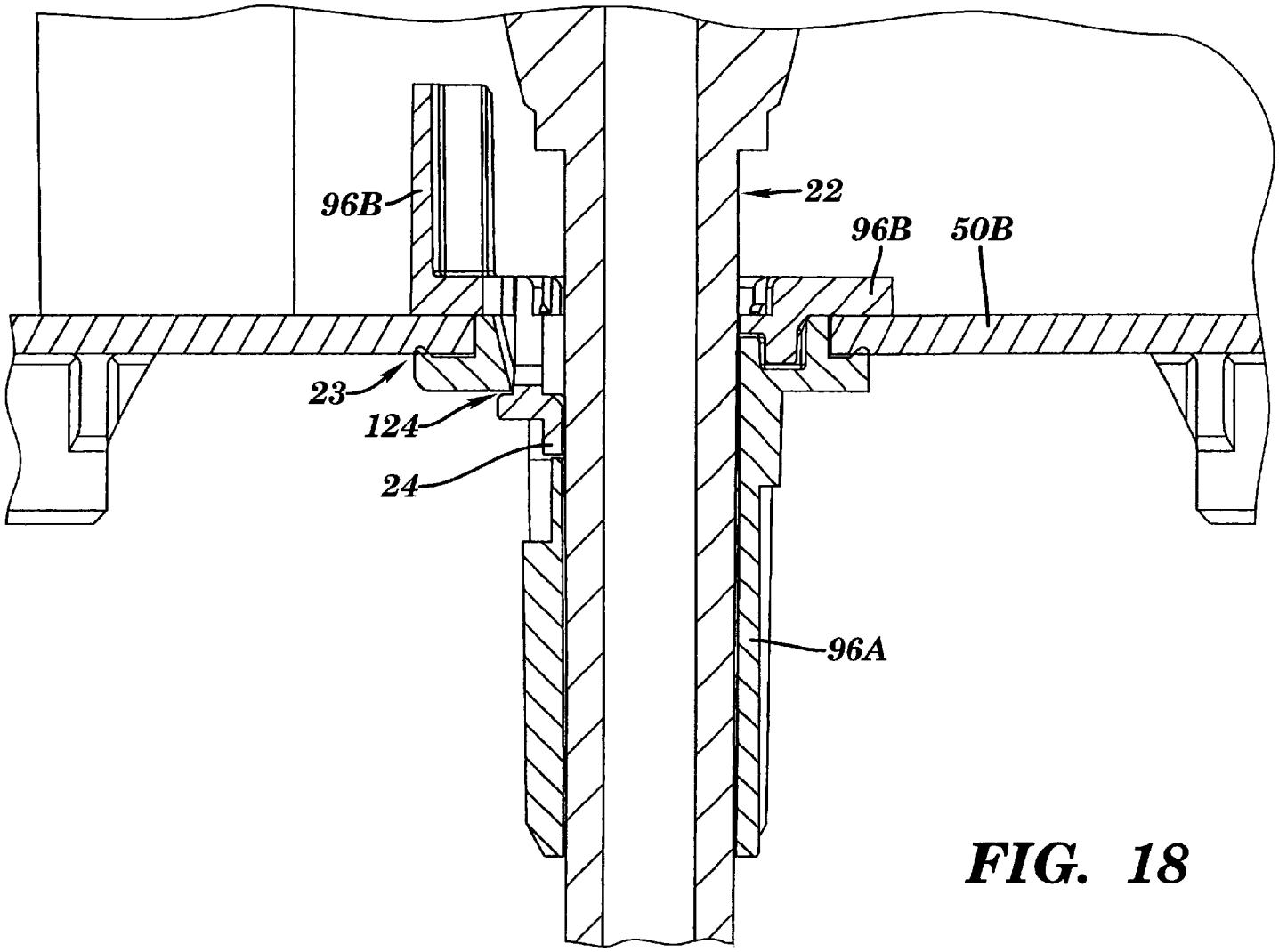
FIG. 18 shows a two-piece hub design in place about a shaft.
Figure 19:
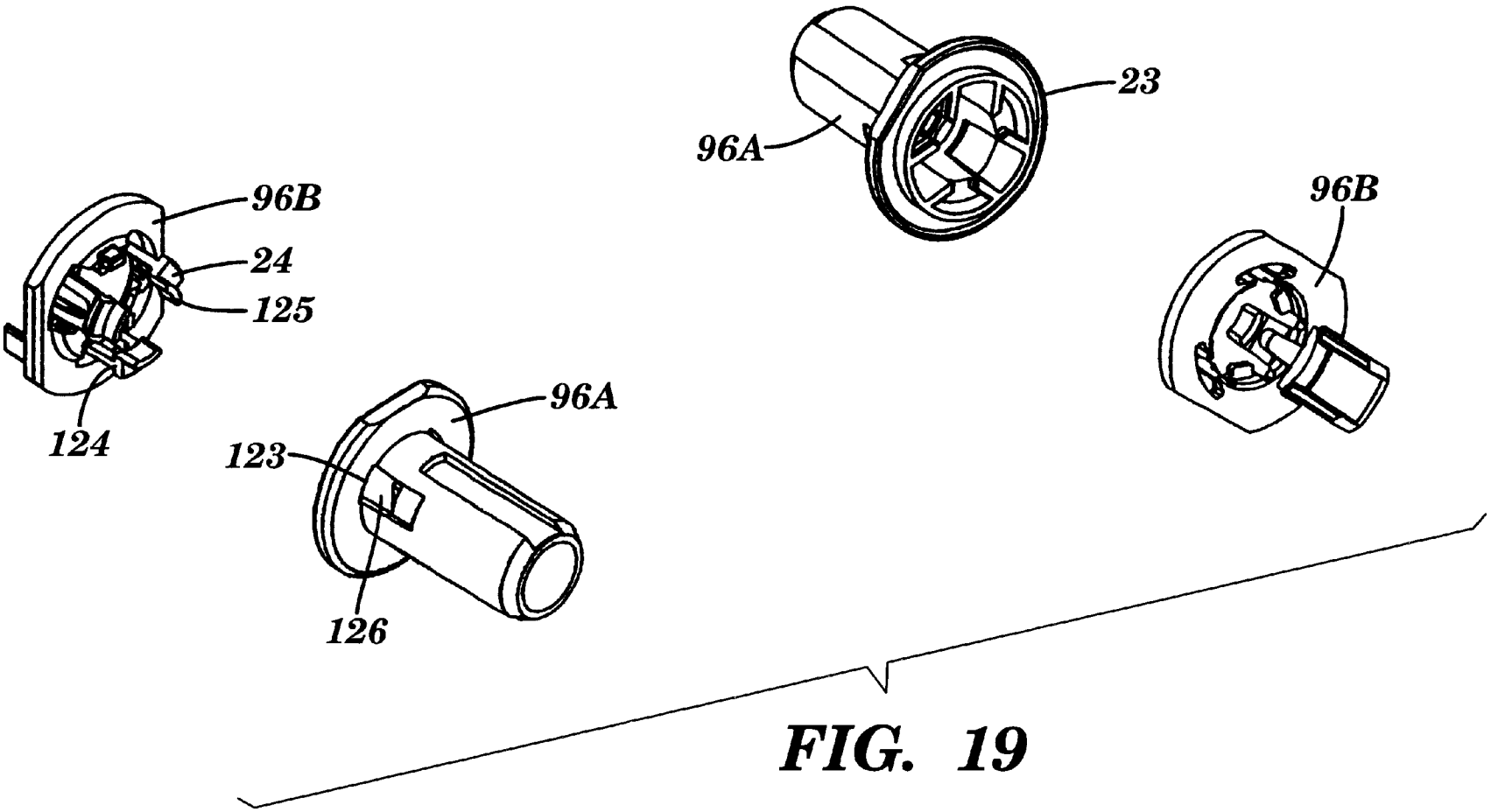
FIG. 19 is an exploded view of a two-piece hub design.

In order to prevent fluids or other contaminants from entering programmer/timer 100, 100' a two-piece, snap together hub 96A, 96B may be employed as shown in FIGS. 18–19. Hub components 96A and 96B are fastened together in any convenient manner, such as by use of conventional mutually engaging snap-type connectors 24. As shown, connectors 24 include an engagement surface 124 that nominally prevents hub components from disengaging. Components 96A and 96B serve to sandwich a portion of housing 50A between them. Shaft 22 then locks the snaps 24 preventing disassembly. Snaps 24 are sized and shaped with sufficient axial dimensions so that when fastened to component 96A, they engage (at engagement surface 124) flange-like portions 123 of component 96A. Lip 23 of component 96A is pressed into engagement with housing 50A, acting as a seal, nominally preventing contaminants from entering the timer. Also, the tip 125 of each snap 24 advantageously seals opening 126, into which a customer's customized dial pointer may be inserted.

Referring again to FIG. 1, motor 52 may be enclosed by housing 50A, 50B to provide a means of double insulating motor 52 to avoid having to ground it. An opening 25 may be provided for the motor coil terminal assembly to penetrate housing 50B for field connection to a customers control wiring. An enclosed motor 52 may provide further advantages in that the field control wiring may be easily disconnected for the purpose of testing motor 52 on the assembled appliance. This tends to be difficult with currently manufactured timers.

Figure 11:
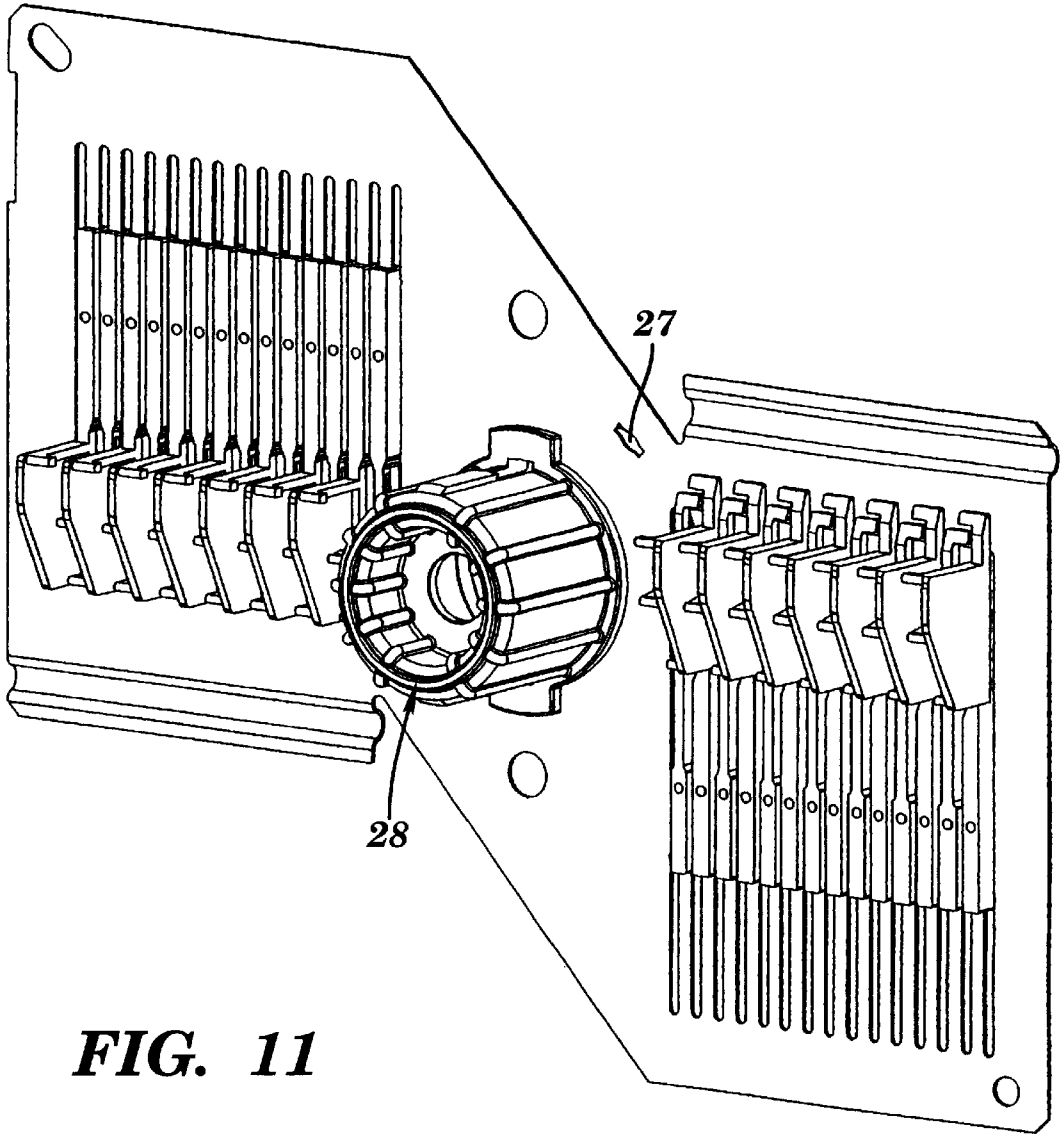
FIG. 11 shows a slot in a plate assembly of the present invention.
Figure 12:
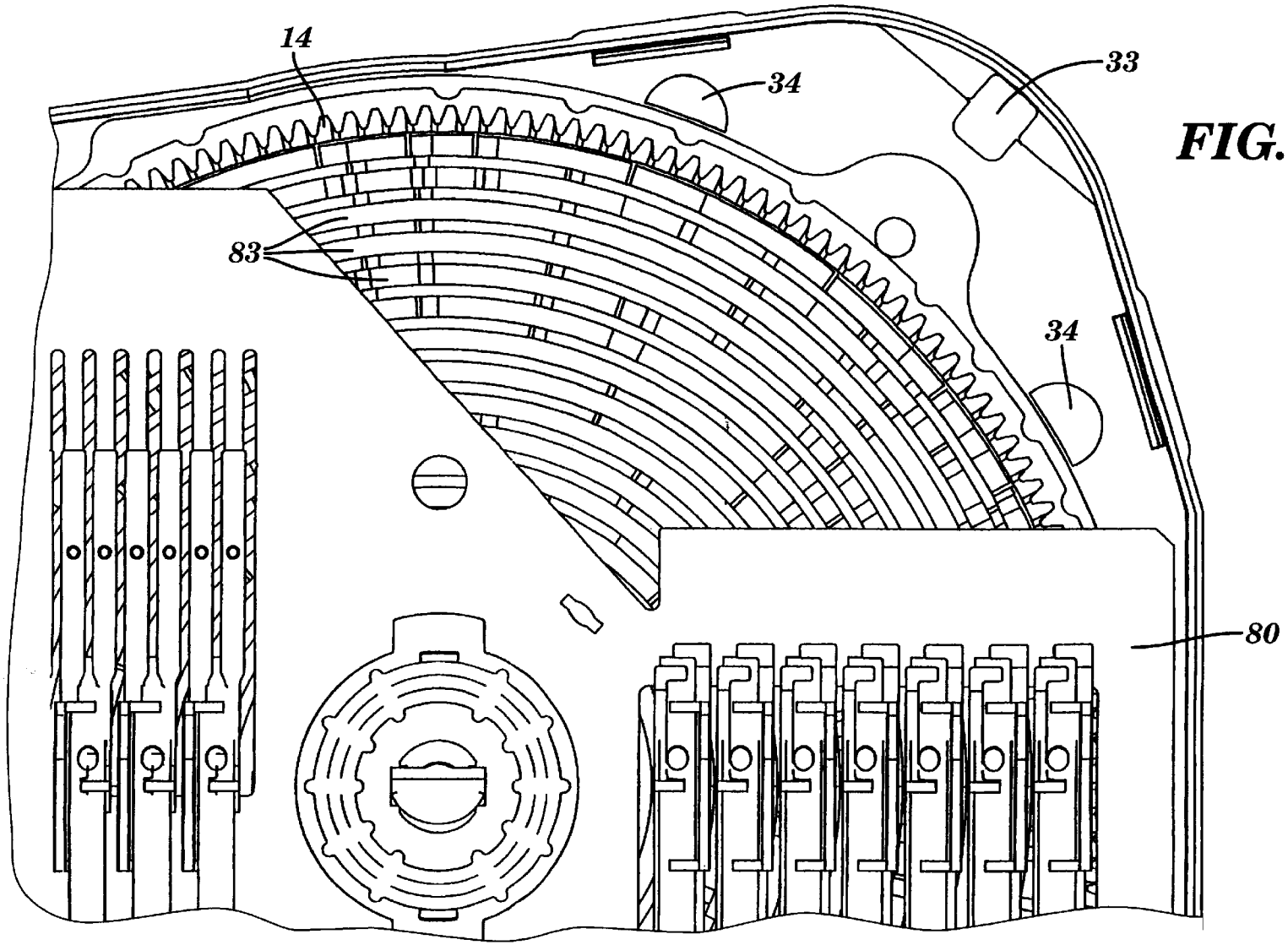
FIG. 12 shows a top-view, housing cutaway of the programmer/timer of this invention without a motor.
Figure 13:
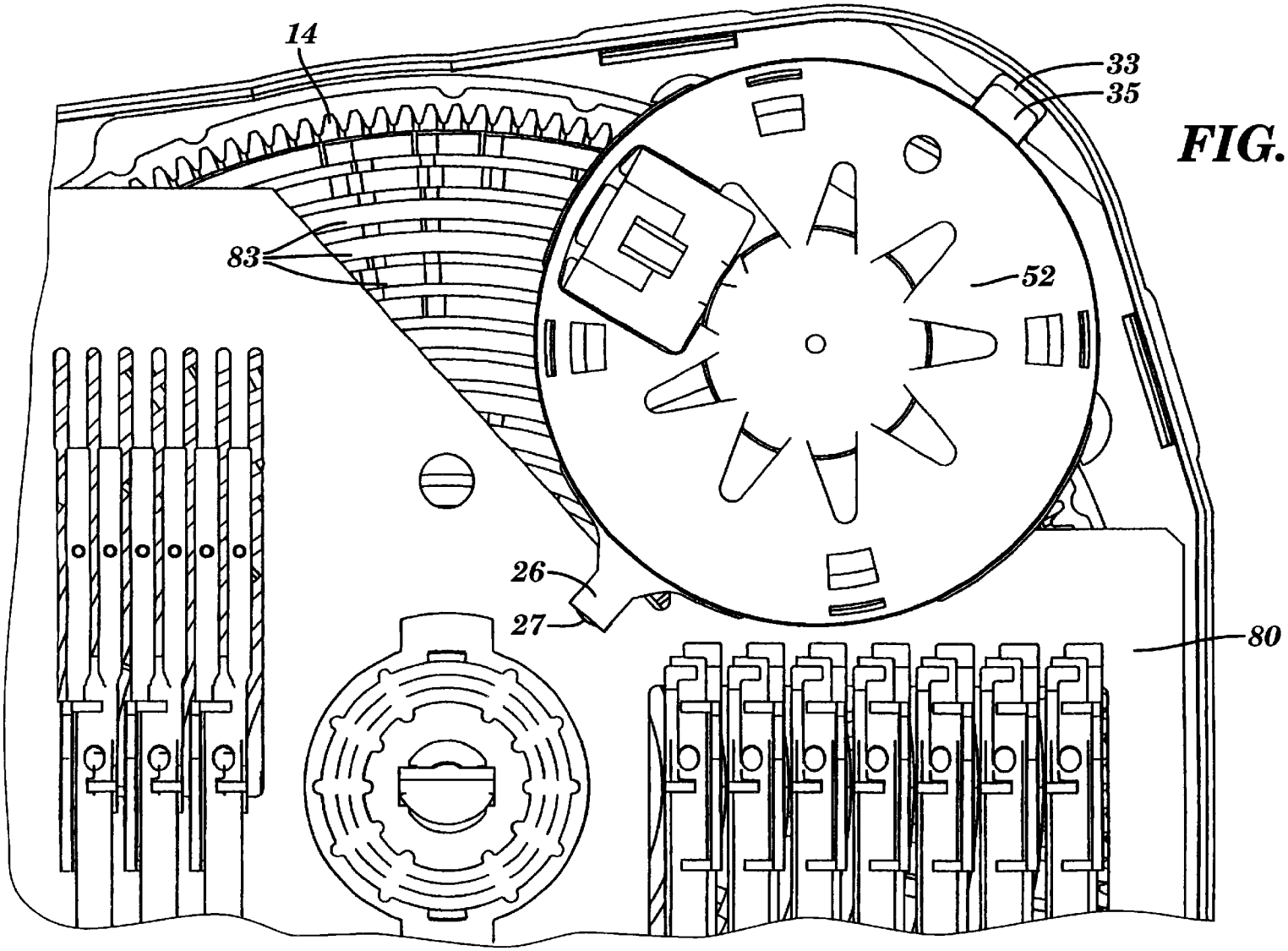
FIG. 13 shows a top-view, housing cutaway of the programmer/timer of this invention with a motor.

It may be preferable to mount motor 52 such that the center distance between motor pinion 13 and gear 14 on the perimeter of disk 1 is fixed. Referring to FIGS. 9–11, a hook 26, formed on the cover of motor 52, is received by a slot 27 on plate assembly 70, 70' which establishes the above mentioned center distance. Housing 50A and 50B secure the motor to prevent rotation about hook 26 and provide support. FIGS. 12–13 show a top view of the timer assembly without and with motor 52, respectively. Housing 50A includes a pocket 33 for the mounting tab 35 of motor 52 to nest in. Pads 34 molded into housing 50A prevent motor 52 from rocking. FIG. 9 shows a boss 36 coming down from housing 50B to trap motor mounting tab 35. Another boss 37 holds motor 52 in place near hook 26. One advantage of the refined mounting method is that it may enable simple assembly of motor 52 to the timer. Motor 52 drops into place and is retained when the housing 50B is snapped onto the device.

Referring to FIGS. 20–21, the main bearing 28 for disk 1 may be molded into plate assembly 70 70', which may remove tolerance stack up between bearing 28 and the cam followers 2. The relationship between bearing 28 and cam followers 2 is controlled by one tool, the insert mold. During the molding operation of follower plate 3, main bearing 28 (which registers to disk 1) and cam followers 2 are molded simultaneously, which tends to eliminate any dimensional variation that results in an off center condition between disk 1 and cam followers 2. This molding operation, therefore, tends to advantageously reduce variation in timing accuracy from timer to timer.

Figure 22C:
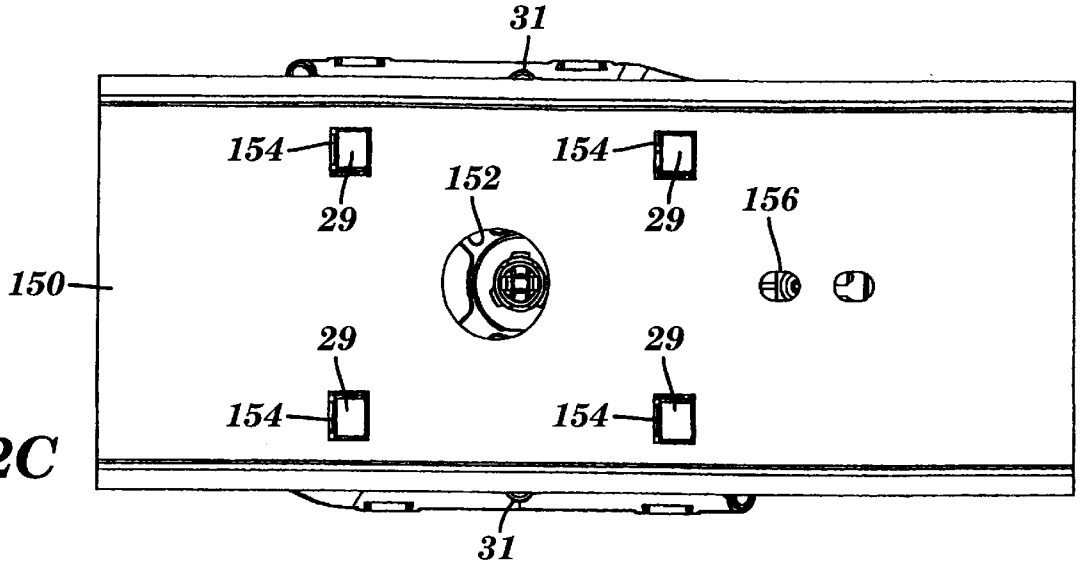
FIGS. 22A–22C shows the means by which one embodiment of this invention is mounted to a panel.
Figure 22A:
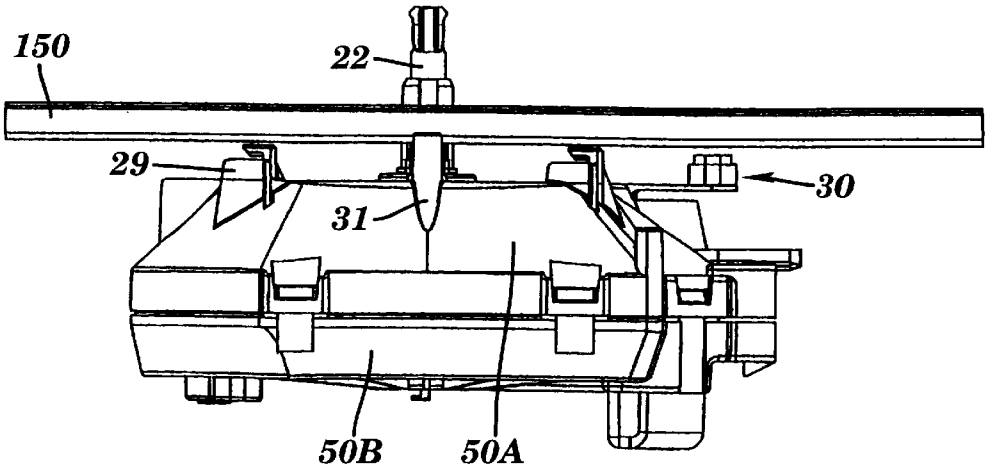
Figure 22B:
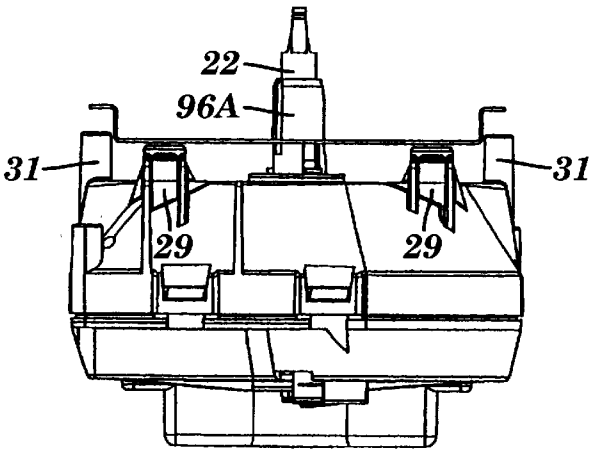
Figure 23:
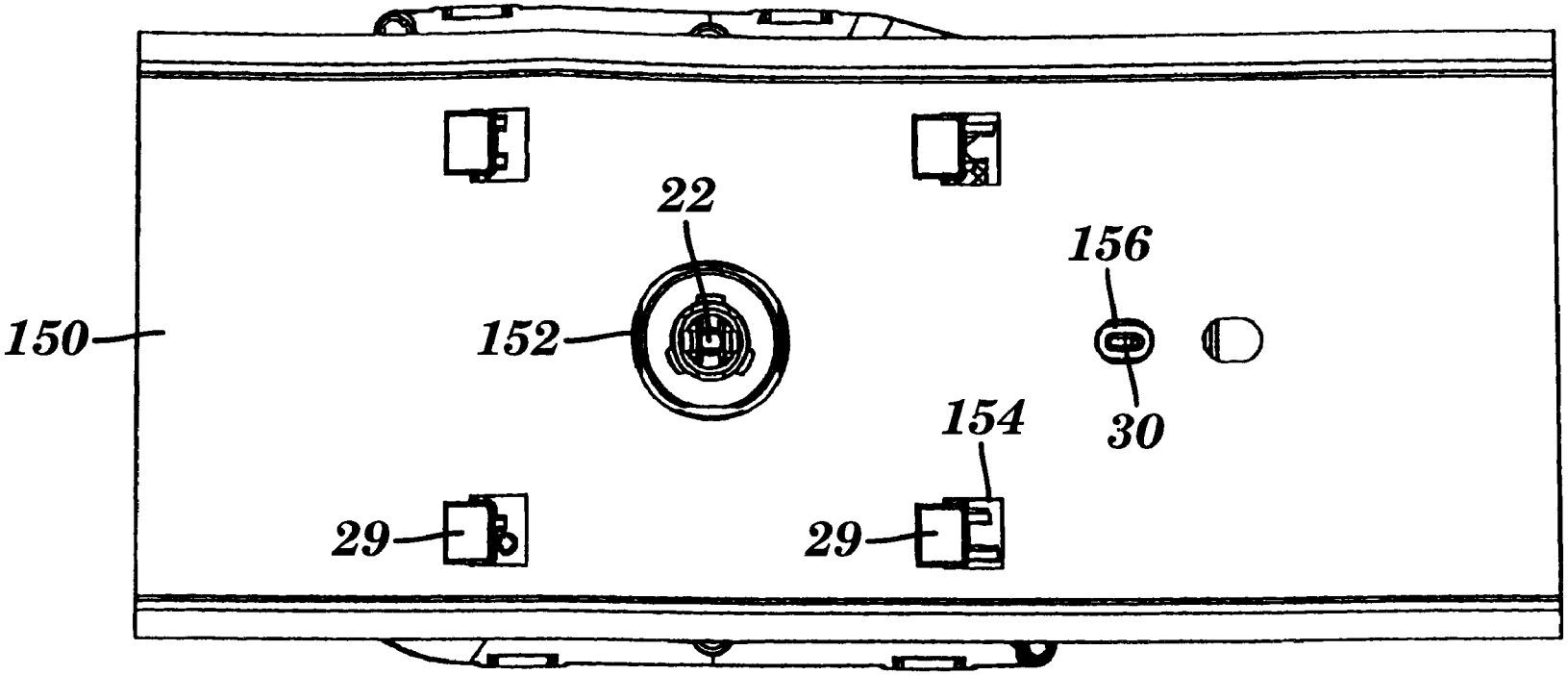
FIG. 23 shows the timer mounted to a customer panel.

Referring to FIGS. 22A–22C, a method of mounting the timer on a customer panel is shown. In this embodiment, housing 50A includes four mounting feet 29, a cantilever-like locking tab 30, and at least two guideposts 31. The mounting process may be thought of as including three steps. First, shaft 22 is inserted into a clearance hole 152 in panel 150 (shown in FIG. 22C). Second, the programmer/timer 100, 100' is moved such that mounting feet 29 drop into four holes 154 in panel 150. Third, the programmer/timer 100, 100' is moved further such that locking tab 30 locks into its corresponding hole 156 in panel 150. Upon successfully mounting the timer, mounting feet 29 trap the metal panel in the undercut on the feet as shown in FIG. 23. To remove programmer/timer 100, 100', locking tab 32 is lifted from hole 156 in panel 150 and the timer is slid back until feet 29 are released from holes 154.

Figure 24:
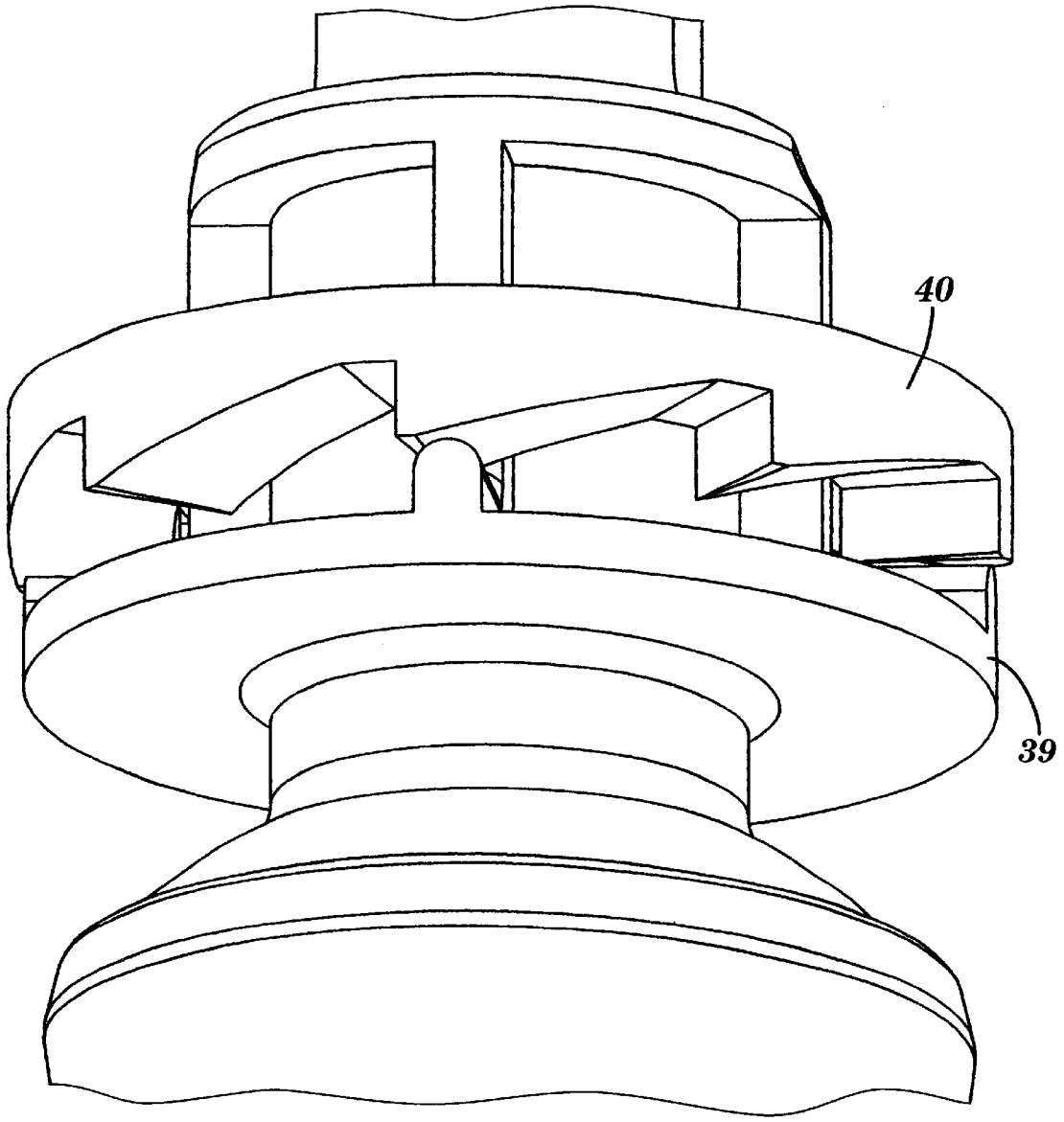
FIG. 24 shows: shaft spline disengaged from a ratchet on the inner diameter of a cam disk hub for providing a single direction turn to set feature.
Figure 25:
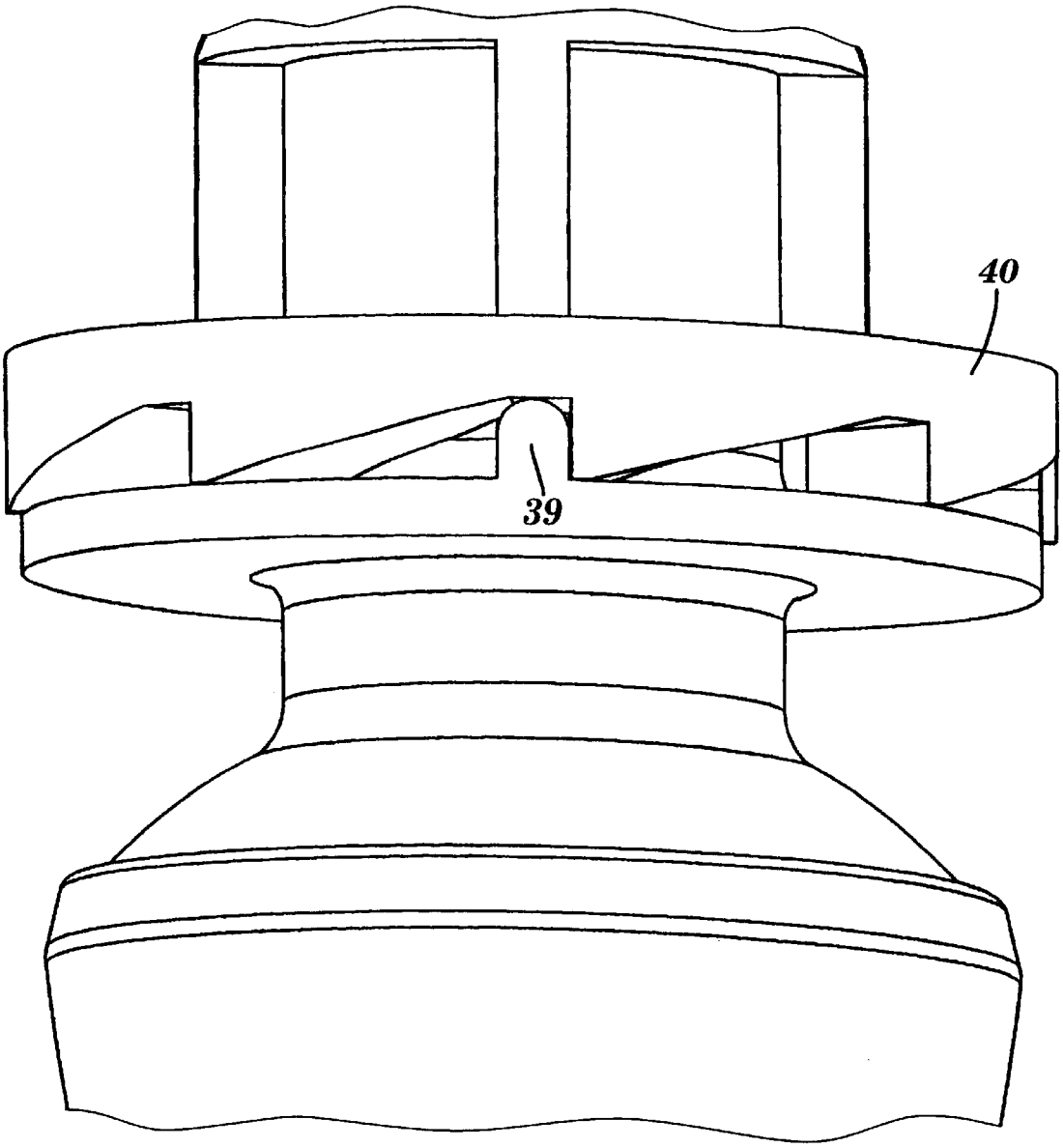
FIG. 25 shows shaft spline engaged with a ratchet on the inner diameter of a cam disk hub for providing a single direction turn to set feature.
Figure 26:
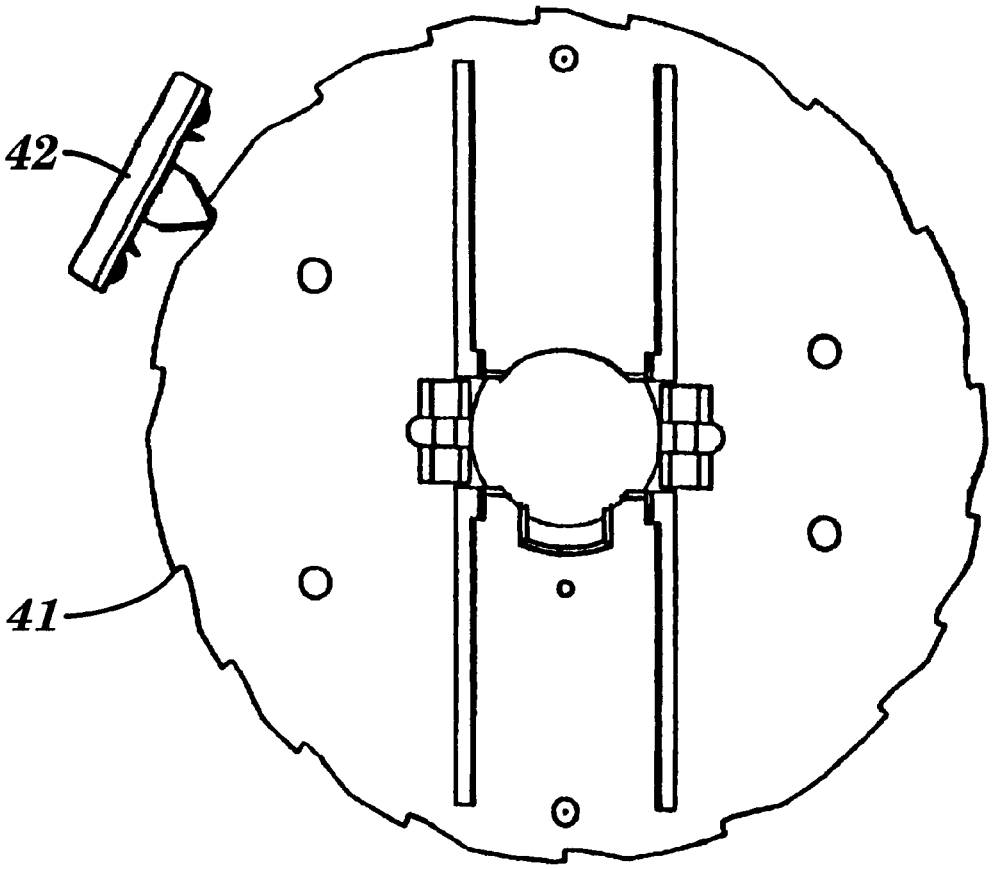
FIG. 26 shows a ratchet on the outer diameter a cam disk engaged with a dial indicator spring for preventing backward rotation of a cam disk.

Embodiments of this invention may be configured such that a user may only turn the appliance control knob in one direction to set programmer/timer 100, 100' to the appropriate program. This feature is referred to as "single direction turn to set". FIGS. 24–26 illustrate the means by which the single direction turn to set feature is achieved. When disk 1 is retracted from cam followers 2, a ratchet 40 on the inside of the disk hub 85, mates with four rib-like spline 39 on shaft 22. For the purpose of this discussion, only the ratcheted area on the inside of disk hub 85 is shown in FIGS. 24 and 25. Ratchet 40 allows shaft 22 to rotate freely when turned in one direction and engages shaft 22 when turned in the other direction. FIG. 24 shows spline 39 engaging ratchet 40. In order to prevent disk 1 from being turned in the wrong direction (which might occur assuming sufficient friction between shaft 22 and disk 1) another ratchet 41 is also included on the outer ring of disk 1. Referring now to FIG. 26, it is shown that ratchet 41 engages dial indicator spring 94, preventing disk 1 from backwards rotation, and forcing the sliding action to occur between spline 39 and ratchet 40. When a user rotates shaft 22 in the correct direction rib-like spline 39 engage ratchet 40 (as shown in FIG. 25) and rotate the disk. An advantage of this feature is that it allows the timer to be designed for either single direction turn to set or bi-directional turn to set with a simple change in an insert used in the disk mold.

The modifications to the various aspects of the present invention described above are merely exemplary. It is understood that other variations will readily occur to persons with ordinary skill in the art. All such modifications and variations are deemed to be within the scope and spirit of the present invention as defined by the accompanying claims.

What is claimed is:

1. An electromechanical programmer/timer comprising:

a cam rotatably mounted about a control shaft and including a plurality of cam tracks thereon, said cam tracks having at least two working heights;

a drive disposed in operable engagement with said cam, to selectively advance said cam;

a plate assembly including a plurality of cam followers, a portion of said plate assembly being registered with a hub portion of said cam;

a plurality of switches, each of said switches being configured for a cam having multiple working heights, wherein said switches are disposed for actuation by said cam followers; and wherein said cam is retractably mounted such that it may be retracted axially from said plate assembly, permitting rotation of said cam without causing actuation of said switches.

2. The electromechanical programmer/timer of claim 1, further comprising a motor disposed on a housing, said motor being disposed in operable engagement with said drive.

3. The electromechanical programmer/timer of claim 1 wherein said switches are configured to be open when said cam is retracted from said plate assembly.

4. The electromechanical programmer/timer of claim 1 further comprising at least one connector, said switches being in electrical contact with said connector.

5. The electromechanical programmer/timer of claim 1 further comprising a first connector and a second connector, at least one of said switches being in electrical contact with said first connector and at least one other of said switches being in electrical contact with said second connector.

6. The electromechanical programmer/timer of claim 5, comprising 14 switches, seven of said switches being in electrical contact with said first connector, the other seven of said switches being in electrical contact with said second connector.

7. The electromechanical programmer/timer of claim 1 wherein said drive includes a motor pinion operably connectable to a motor and operably engageable with a perimeter gear on said cam.

8. The electromechanical programmer/timer of claim 7 wherein said motor pinion is adapted to receive a driver insertable therein to facilitate external testing of said drive.

9. The electromechanical programmer/timer of claim 1 further comprising a detent spring for urging said cam into contact with said cam followers, said detent spring including a plurality of opposing cantilevers.

10. The electromechanical programmer/timer of claim 1 further comprising a dial indicator spring for providing tactile feedback to a user, said dial indicator spring including a follower tip which releasably engages notches on the perimeter of said cam.

11. The electromechanical programmer/timer of claim 10 wherein said dial indicator spring further includes a barb formed on each leg thereof.

12. The electromechanical programmer/timer of claim 2 further comprising a two-piece hub, said two-piece hub being fastened together about said control shaft, sandwiching a portion of said housing therebetween.

13. The electromechanical programmer/timer of claim 2 wherein said motor is enclosed by said housing to insulate said motor, said housing including an opening to receive a motor coil terminal assembly.

14. The electromechanical programmer/timer of claim 2 wherein said motor includes a hook on the cover thereof, said hook being receivable by a slot on said plate assembly.

15. The electromechanical programmer/timer of claim 1 further comprising a main bearing, said main bearing being molded into said plate assembly.

16. The electromechanical programmer/timer of claim 2 wherein said housing includes four angled feet, a cantilever-like locking tab and at least two posts for mounting said programmer/timer to a customer panel.

17. The electromechanical programmer/timer of claim 1, wherein said cam and said control shaft comprise means to provide a single direction turn-to-set feature.

18. The electromechanical programmer/timer of claim 17, wherein said means to provide a single direction turn-to-set feature includes the mating of a ratchet integral with an inner diameter of the cam with at least two rib-like splines integral with said control shaft.

19. The electromechanical programmer/timer of claim 1, wherein said cam includes a cam disk having a plurality of cam tracks disposed thereon, said cam tracks having at least two working heights.

20. An electromechanical programmer/timer comprising:

a housing including a motor mounted thereon, said motor being enclosed by said housing, said housing further including an opening for motor coil terminal assembly to penetrate;

a cam rotatably mounted about a control shaft and including a cam disk that includes a plurality of cam tracks thereon, said cam tracks having multiple heights;

drive means including a motor pinion operably connected to said motor and operably engagable with a perimeter gear on said cam disk;

a plate assembly including a plurality of cam followers and a main bearing molded thereon;

a plurality of switches, each of said switches each including at least one cam follower and being configured for a cam having multiple working heights, each of said cam followers being disposed for actuation by contacting one of said plurality of cam tracks;

wherein said cam is retractably mounted such that it may be retracted axially from said plate assembly, permitting rotation of said cam without causing actuation of said switches; and wherein said switches are configured to be open when said cam is retracted from said plate assembly.

21. A method for fabricating an electromechanical program timer, said method comprising:

providing a housing including a motor mounted thereon;

providing a cam rotatably mounted about a control shaft and including a plurality of cam tracks thereon, said cam tracks having at least two working heights;

providing a drive operably connected to said motor and effectual for advancing said cam;

providing a plate assembly including a plurality of cam followers, a portion of said plate assembly being registerable with a hub portion of said cam;

providing a plurality of switches which are configured for a cam having multiple working heights, said switches being disposable for actuation by said cam followers wherein said cam is retractably mounted such that it may be retracted from plate assembly, permitting of said cam without causing actuation of said switches; and assembling said housing, said cam, said drive, said plate assembly and said plurality of switches with one another.

* * * * *